US005774837A

United States Patent [19]

Yeldener et al.

[11] Patent Number: 5,774,837

[45] Date of Patent: Jun. 30, 1998

[54] SPEECH CODING SYSTEM AND METHOD USING VOICING PROBABILITY DETERMINATION

[75] Inventors: Suat Yeldener, Plainsboro, N.J.; Joseph Gerard Aguilar, Oak Lawn, Ill.

[73] Assignee: Voxware, Inc., Princeton, N.J.

[21] Appl. No.: 528,513

[22] Filed: Sep. 13, 1995

[51] Int. Cl.[6] ..... G10L 7/02; G10L 9/14

[52] U.S. Cl. ..... 704/208; 704/206; 704/219; 704/262; 704/268

[58] Field of Search ..... 395/2.15, 2.17, 395/2.28, 2.71, 2.77; 704/206, 208, 219, 262, 268

[56] References Cited

U.S. PATENT DOCUMENTS

| | | | |
|---|---|---|---|
| 4,374,302 | 2/1983 | Vogten et al. | 395/2.74 |
| 4,392,018 | 7/1983 | Fette | 395/2.74 |
| 4,433,434 | 2/1984 | Mozer | 395/2.2 |
| 4,435,831 | 3/1984 | Mozer | 395/2.71 |
| 4,435,832 | 3/1984 | Asada et al. | 395/2.71 |
| 4,468,804 | 8/1984 | Kates et al. | 395/2.74 |
| 4,771,465 | 9/1988 | Bronson et al. | 395/2.16 |
| 4,797,926 | 1/1989 | Bronson et al. | 395/2.23 |
| 4,802,221 | 1/1989 | Jibbe | 395/2.17 |
| 4,856,068 | 8/1989 | Quatieri, Jr. et al. | 395/2.36 |
| 4,864,620 | 9/1989 | Bialick | 395/2.16 |
| 4,885,790 | 12/1989 | McAulay et al. | 395/2.74 |
| 4,937,873 | 6/1990 | McAulay et al. | 395/2.74 |
| 4,945,565 | 7/1990 | Ozawa et al. | 395/2.32 |
| 4,991,213 | 2/1991 | Wilson | 395/2.16 |
| 5,023,910 | 6/1991 | Thomson | 395/2.15 |
| 5,054,072 | 10/1991 | McAulay et al. | 395/2.16 |
| 5,081,681 | 1/1992 | Hardwick et al. | 395/2.77 |
| 5,189,701 | 2/1993 | Jain | 395/2.16 |
| 5,195,166 | 3/1993 | Hardwick et al. | 395/2.09 |
| 5,216,747 | 6/1993 | Hardwick et al. | 395/2.17 |
| 5,226,084 | 7/1993 | Hardwick et al. | 395/2.28 |
| 5,226,108 | 7/1993 | Hardwick et al. | 395/2.09 |

(List continued on next page.)

FOREIGN PATENT DOCUMENTS

| | | | |
|---|---|---|---|
| 0 676 744 A1 | 10/1995 | European Pat. Off. | G10L 9/14 |
| WO 94/12972 | 6/1994 | WIPO | G10L 9/00 |

OTHER PUBLICATIONS

Yeldener, Suat et al., "A High Quality 2.4 kb/s Multi–Band LPC Vocoder and its Real–Time Implementation". Center for Satellite Engineering Research, University of Surrey. pp. 14. Sep. 1992.

(List continued on next page.)

*Primary Examiner*—Allen R. MacDonald
*Assistant Examiner*—Tálivaldis Ivars Šmits
*Attorney, Agent, or Firm*—Pennie & Edmonds LLP

[57] ABSTRACT

A modular system and method is provided for encoding and decoding of speech signals using voicing probability determination. The continuous input speech is divided into time segments of a predetermined length. For each segment the encoder of the system computes the signal pitch and a parameter which is related to the relative content of voiced and unvoiced portions in the spectrum of the signal, which is expressed as a ratio Pv, defined as a voicing probability. The voiced portion of the signal spectrum, as determined by the parameter Pv, is encoded using a set of harmonically related amplitudes corresponding to the estimated pitch. The unvoiced portion of the signal is processed in a separate processing branch which uses a modified linear predictive coding algorithm. Parameters representing both the voiced and the unvoiced portions of a speech segment are combined in data packets for transmission. In the decoder, speech is synthesized from the transmitted parameters representing voiced and unvoiced portions of the speech in a reverse order. Boundary conditions between voiced and unvoiced segments are established to ensure amplitude and phase continuity for improved output speech quality. Perceptually smooth transition between frames is ensured by using an overlap and add method of synthesis. Also disclosed is the use of the system in the generation of a variety of voice effects.

34 Claims, 16 Drawing Sheets

U.S. PATENT DOCUMENTS

| | | | |
|---|---|---|---|
| 5,247,579 | 9/1993 | Hardwick et al. | 395/2.39 |
| 5,267,317 | 11/1993 | Kleijn | 395/2.26 |
| 5,303,346 | 4/1994 | Fesseler et al. | 395/2.39 |
| 5,327,518 | 7/1994 | George et al. | 395/2.2 |
| 5,327,521 | 7/1994 | Savic et al. | 395/2.81 |
| 5,339,164 | 8/1994 | Lim | 358/261.1 |
| 5,353,373 | 10/1994 | Drogo de Iacovo et al. | 395/2.32 |
| 5,369,724 | 11/1994 | Lim | 395/2.15 |
| 5,491,772 | 2/1996 | Hardwick et al. | 395/2.35 |
| 5,517,511 | 5/1996 | Hardwick et al. | 371/37.4 |

OTHER PUBLICATIONS

Yeldener, Suat et al., "Natural Sounding Speech Coder Operating at 2.4 Kb/s and Below", 1992 IEEE International Conference as Selected Topics in Wireless Communication, 25–26 Jun. 1992, Vancouver, BC, Canada, pp. 176–179.

Yeldener, Suat et al., "Low Bit Rate Speech Coding at 1.2 and 2.4 Kb/s", IEE Colloquium on Speech Coding—Techniques and Applications' (Digest No. 090) pp. 611–614, Apr. 14, 1992. London, U.K.

Yeldener, Suat et al., "High Quality Multi–Band LPC Coding of Speech at 2.4 Kb/s", Electronics Letters, v.27, N14, Jul. 4, 1991, pp. 1287–1289.

Medan, Yoav., "Super Resolution Pitch Determination of Speech Signals". IEEE Transactions on Signal Processing, vol. 39, No. 1, Jan. 1991.

McAulay, Robert J. et al., "Computationally Efficient Sine–Wave Synthesis and its Application to Sinusoidal Transform Coding" M.I.T. Lincoln Laboratory, Lexington, MA. 1988 IEEE, S9.1 pp. 370–373.

Hardwick, John C., "A 4.8 KBPS Multi–Band Excitation Speech Coder". M.I.T. Research Laboratory of Electronics; 1988 IEEE, S9.2., pp. 374–377.

Thomson, David L., "Parametric Models of the Magnitude/Phase Spectrum for Harmonic Speech Coding". AT&T Bell Laboratories; 1988 IEEE, S9.3., pp. 378–381.

Marques, Jorge S. et al., "A Background for Sinusoid Based Representation of Voiced Speech". ICASSP 86, Tokyo, pp. 1233–1236.

Trancoso, Isabel M., et al., "A Study on the Relationships Between Stochastic and Harmonic Coding", INESC, ICASSP 86, Tokyo. pp. 1709–1712.

McAulay, Robert J. et al., "Phase Modelling and its Application to Sinusoidal Transform Coding". M.I.T. Lincoln Laboratory, Lexington, MA. 1986 IEEE, pp. 1713–1715.

McAulay, Robert J. et al., "Mid–Rate Coding Based on a Sinusoidal Representation of Speech". Lincoln Laboratory, Massachusetts Institute of Technology, Lexington, MA. 1985 IEEE, pp. 945–948.

Almeida, Luis B., "Variable–Frequency Synthesis: An Improved Harmonic Coding Scheme". 1984, IEEE, pp. 27.5.1–27.5.4.

McAulay, Robert J. et al., "Magnitude–Only Reconstruction Using A Sinusoidal Speech Model". M.I.T. Lincoln Laboratory, Lexington, MA. 1984 IEEE, pp. 27.6.1–27.6.4.

Nats Project; Eigensystem Subroutine Package (Eispack) F286–2 Hor. "A Fortran IV Subroutine to Determine the Eigenvalues of a Real Upper Hessenberg Matrix", Jul. 1975, pp. 330–337.

Daniel W. Griffin and Jae S. Lim, "Multiband Excitation Vocoder", IEEE Transactions on Acoustics, Speech, and Signal Processing, vol. 36, No. 8, pp. 1223–1235, Aug. 1988.

Masayuki Nishiguchi Jun Matsumoto, Ryoji Wakatsuki, and Shinobu Ono, "Vector Quantized MBE with Simplified V/UV Division at 3.0 Kbps", Proceedings of International Conference on Acoustics Speech and Signal Processing (ICASSP '93), vol. II, pp. 141–154, Apr. 1993.

SPEECH CODING SYSTEM AND METHOD USING VOICING PROBABILITY DETERMINATION

BACKGROUND OF THE INVENTION

The present invention relates to speech processing and more specifically to a method and system for digital encoding and decoding of speech using harmonic analysis and synthesis of the voiced portions and predictive coding of the unvoiced portions of speech segments on the basis of a voicing probability determination.

Systems for digital transmission and storage of speech and other audio signals are known to perform significantly better than corresponding analog systems. The inherent advantages of the digital communication and storage techniques are primarily due to the fact that information is transmitted and stored in a binary form which is much less susceptible to noise, electronic component distortions and other distortions in conventional analog systems. In addition, the representation of the speech signals in a digital form enables the use of noise reduction techniques and advanced signal processing algorithms which may be difficult or impossible to implement when operating on conventional analog signals. Digital signal representation and processing can also ensure exact repeatability of the system output signals, regardless of the electronic circuitry or transmission media.

The advantages of digital transmission techniques come, however, at the expense of a wider required frequency bandwidth. This is particularly true in the case of high fidelity sound systems and modern multimedia systems where large volumes of data have to be processed and stored, often in real time. It appears that in the future the demand for information storage, voice effect transformations and data exchange will grow at an even faster pace. This demand, due to the physical limitations of the available communication channels and the electronic circuitry, at present poses serious technical problems.

For practical digital speech signal transformation, communication and storage purposes it is thus necessary to reduce the amounts of data to be transmitted and stored by eliminating redundant information without noticeable perceptual effects. It is further desirable to design improved systems which maximize the amount of data processed per unit time using signal compression. Generally, any signal compression is based on the presence of superfluous information in the original signal that can be removed to reduce the amount of data to be stored or transmitted. There are two main classes of information superfluous with respect to the intended receiver. The first one is known as statistical redundancy, which is primarily associated with similarities, correlation and predictability of data. Such statistical redundancy can theoretically be removed from the data without any information being lost.

The second class of superfluous information is known as subjective redundancy, which primarily has to do with data characteristics that can be removed without a human observer noticing degradation. Unlike statistical redundancy, the removal of subjective redundancy is typically irreversible, so that the original data cannot be fully recovered.

There are some well known prior art speech signal compression and coding techniques which exploit both types of signal redundancies. Generally, they may be classified as predictive coding, transform coding and interpolative coding. Numerous techniques may not fall into those classes, since they combine features of one technique or another. There appears to be a consensus, however, that no single technique is likely to succeed in all applications. The reason for this is that the performance of digital compression and coding systems for voice signals is highly dependent on the speaker and the selection of speech frames. The success of a technique selected in each particular application thus frequently depends on the accuracy of the underlying signal model. As known in the art, various speech signal models have been proposed in the past.

Most frequently, speech is modeled on a short-time basis as the response of a linear system excited by a periodic impulse train for voiced sounds or random noise for the unvoiced sounds. For mathematical convenience, it is assumed that the speech signal is stationary within a given short time segment, so that the continuous speech is represented as an ordered sequence of distinct voiced and unvoiced speech segments.

Voiced speech segments, which correspond to vowels in a speech signal, typically contribute most to the intelligibility of the speech which is why it is important to accurately represent these segments. However, for a low-pitched voice, a set of more than 80 harmonic frequencies ("harmonics") may be measured within a voiced speech segment within a 4 kHz bandwidth. Clearly, encoding information about all harmonics of such segment is only possible if a large number of bits is used. Therefore, in applications where it is important to keep the bit rate low, more sophisticated speech models need to be employed.

One conventional solution for encoding speech is based on a sinusoidal speech representation model. U.S. Pat. No. 5,054,072 to McAuley for example describes a method for speech coding which uses a pitch extraction algorithm to model the speech signal by means of a harmonic set of sinusoids that serve as a "perceptual" best fit to the measured sinusoids in a speech segment. The system generally attempts to encode the amplitude envelope of the speech signal by interpolating this envelope with a reduced set of harmonics. In a particular embodiment, one set of frequencies linearly spaced in the baseband (the low frequency band) and a second set of frequencies logarithmically spaced in the high frequency band are used to represent the actual speech signal by exploiting the correlation between adjacent sinusoids. A pitch adaptive amplitude coder is then used to encode the amplitudes of the estimated harmonics. The proposed method, however, does not provide accurate estimates, which results in distortions of the synthesized speech.

The McAuley patent also provides a sinusoidal speech model in which phases of base band signals are computed and transmitted, while phases in high frequency bands are randomized in order to generate an unvoiced speech signal. This phase model, however, requires the transmission of additional bits to encode the baseband harmonics phases so that very low bit rates may not be achieved readily.

U.S. Pat. No. 4,771,465 describes a speech analyzer and synthesizer system using a sinusoidal encoding and decoding technique for voiced speech segments and noise excitation or multipulse excitation for unvoiced speech segments. In the process of encoding the voiced segments a fundamental subset of harmonic frequencies is determined by a speech analyzer and is used to derive the parameters of the remaining harmonic frequencies. The harmonic amplitudes are determined from linear predictive coding (LPC) coefficients. The method of synthesizing the harmonic spectral amplitudes from a set of LPC coefficients, however, requires extensive computations and yields relatively poor quality speech.

U.S. Pat. Nos. 5,226,108 and 5,216,747 to Hardwick et al. describe an improved pitch estimation method providing sub-integer resolution. The quality of the output speech according to the proposed method is improved by increasing the accuracy of the decision as to whether given speech segment is voiced or unvoiced. This decision is made by comparing the energy of the current speech segment to the energy of the preceding segments. The proposed methods, however, generally do not allow accurate estimation of the amplitude information for all harmonics.

U.S. Pat. No. 5,226,084 also to Hardwick et al. describes methods for quantizing speech while preserving its perceptual quality. To this end, harmonic spectral amplitudes in adjacent speech segments are compared and only the amplitude changes are transmitted to encode the current frame. A segment of the speech signal is transformed to the frequency domain to generate a set of spectral amplitudes. Prediction spectral amplitudes are then computed using interpolation based on the actual spectral amplitudes of at least one previous speech segment. The differences between the actual spectral amplitudes for the current segment and the prediction spectral amplitudes derived from the previous speech segments define prediction residuals which are encoded. The method reduces the required bit rate by exploiting the amplitude correlation between the harmonic amplitudes in adjacent speech segments, but is computationally expensive.

In an approach related to the harmonic signal coding techniques discussed above, it has been proposed to increase the accuracy of the signal reconstruction by using a series of binary voiced/unvoiced decisions corresponding to each speech frame in what is known in the art as multiband excitation (MBE) coders. The MBE speech coders provide more flexibility in the selection of speech voicing compared with traditional vocoders, and can be used to generate good quality speech. In fact, an improved version of the MBE (IMBE) vocoder operating at 4.15 kb/s, with forward error correction (FEC) making it up to 6.4 kb/s, has been chosen for use in INMARSAT-M. In these speech coders, however, typically the number of harmonic magnitudes in the 4 kHz bandwidth varies with the fundamental frequency, requiring variable bit allocation for each harmonic magnitude from one frame to another, which can result in variable speech quality for different speakers. Another limitation of the IMBE coder is that the bit allocation for the model parameters depends on the fundamental frequency, which reduces the robustness of the system to channel errors. In addition, errors in the voiced/unvoiced decisions, especially when made in the low frequency bands, result in perceptually objectionable degradation in the quality of the output speech.

Therefore, it is perceived that there exists a need for more flexible methods for encoding and decoding of speech, which can be used in both low- and high bit rate applications. Accordingly, there is a present need to develop a modular system in which optimized processing of different speech segments, or speech spectrum bands, is performed in specialized processing blocks to achieve best results for different types of speech and other acoustic signal processing applications. Furthermore, there is a need to more accurately classify each speech segment in terms of its voiced/unvoiced content in order to apply optimum signal compression for each type of signal. In addition, there is a need to obtain accurate estimates of the amplitudes of the spectral harmonics in voiced speech segments in a computationally efficient way and to develop a method and system to synthesize such voiced speech segments without the requirement to store or transmit separate phase information.

SUMMARY OF THE INVENTION

Accordingly, it is an object of the present invention to provide a modular system and method for encoding and decoding of speech signals using adaptive harmonic analysis and synthesis of the voiced portions and prediction coding of the unvoiced portions of a speech signal on the basis of a voicing probability determination.

It is another object of the present invention to provide a super resolution harmonic amplitude estimator for approximating the speech signal in a voiced time segment as a set of harmonic frequencies within the voiced band of the speech signal.

It is another object of the present invention to provide a novel phase compensated harmonic synthesizer to synthesize speech in the voiced band of the spectrum from a set of harmonic amplitudes and combine the generated speech segment with adjacent speech segments with minimized amplitude and phase distortions to obtain output speech of good perceptual quality.

These and other objectives are achieved in accordance with the present invention by means of a novel modular encoder/decoder speech processing system in which the input speech signal is represented as a sequence of time segments of predetermined length. For each input segment a determination is made as to detect the presence and estimate the frequency of the pitch $F_0$ of the speech signal within the time segment. Next, on the basis of the estimated pitch is determined the probability that the speech signal within the segment contains voiced speech patterns. In accordance with a preferred embodiment of the present invention, it is assumed that the low frequency portion of the signal spectrum contains a predominantly voiced signal, while the high frequency portion of the spectrum contains predominantly the unvoiced portion of the speech signal.

For each speech frame the ratio between the voiced and unvoiced portions of the speech spectrum, as defined above, changes. Thus, for each frame it is necessary to determine a border point between the voiced and unvoiced portions of the speech spectrum. In the present invention this ratio is defined as the voicing probability Pv of the signal within a specific time segment. Thus, if Pv=1 the signal is purely voiced and only has harmonically related components; if Pv=0, the speech segment is purely unvoiced and can be modeled as a filtered noise.

Dependent on the value of the voicing probability Pv, each time segment is represented in the encoder as a data packet, a signal vector which contains a set of information parameters. The portion of the speech segment which is determined to be unvoiced is preferably represented by elements of a linear predictive coding (LPC) vector and a gain parameter corresponding to the total energy of the unvoiced excitation signal. The remaining portion of the speech segment which is considered to be voiced, is preferably represented by a vector, the elements of which are harmonically related spectral amplitudes. Additional control information including the pitch Fo and the total energy of the voiced portion of the signal segment is attached to each predictive coding and harmonic amplitudes vector to form a data packet of variable length for each given speech segment. Thus, a data packet corresponding to a time segment of speech is a complete digital representation of that segment of the input speech. An ordered sequence of data packets which represent successive input speech segments is finally transmitted or stored for subsequent synthesis.

More specifically, after the analog input speech signal is digitized and divided into time segments, the system of the present invention determines the voicing probability Pv for the segment using a specialized pitch detection algorithm. In order to estimate the voicing probability, a synthetic speech spectrum is created assuming that this speech is purely voiced. Next, the original and synthetic excitation spectra corresponding to each harmonic of fundamental frequency are compared. Due to the fact that the synthetic speech spectrum by design corresponds to a purely voiced signal, the normalized error is relatively small for the actual voiced harmonics and relatively large for unvoiced harmonics in the actual speech. Therefore, the normalized error for the frequency bin around each harmonic can be used to decide whether the corresponding portion of the spectrum is voiced or unvoiced by comparing it to a frequency-dependent adaptive error threshold. The value of the threshold level is set in a way such that a perceptually "proper" mix of voiced and unvoiced energy is obtained, and is mathematically expressed by the use of a set of constants which can be determined quantitatively from tests on a group of listeners.

If the normalized error within a frequency bin is less than the value of the frequency dependent adaptive threshold the corresponding bin is determined to be voiced; otherwise the bin is considered to be unvoiced. In accordance with the present invention the voicing probability Pv is computed as the ratio of the number of voiced frequency bands over the total number of bands in the spectrum of the signal.

Once the voicing probability Pv is determined, the speech segment is separated into a voiced portion, which is assumed to occupy all frequency bins up to and including the bin which covers a Pv portion of the spectrum, and an unvoiced portion. The unvoiced portion of the speech is computed in a specific embodiment of the present invention by zeroing out spectral components within the voiced portion of the signal spectrum and inverse transforming back in the time domain the remaining spectrum components. Each signal portion is then encoded separately using a different processing algorithm.

In the system of the present invention the unvoiced portion of the signal is modeled next using a set of linear prediction coefficients (LPC) as known in the art. For optimal storage and transmission the LPC coefficients are next replaced with a set of corresponding line spectral frequencies (LSF) coefficients which have been determined for practical purposes to be less sensitive to quantization.

The voiced portion of the signal is passed to a harmonic amplitude estimator which estimates the amplitudes of the harmonic frequencies of the speech segment and supplies on output a vector of normalized harmonic amplitudes representative of the voiced portion of the speech segment.

A parameter encoder finally generates for each time segment of the speech signal a data packet, the elements of which contain information necessary to restore the original speech segment. In a preferred embodiment of the present invention, a data packet comprises: control information, the voicing probability Pv, the excitation power, the sum total of harmonic amplitudes in the voiced portion of the signal spectrum, the fundamental frequency and a set of estimated normalized harmonic amplitudes. The ordered sequence of data packets at the output of the parameter encoder is ready for storage or transmission of the original speech signal.

At the synthesis end, a decoder receives the ordered sequence of data packets representing speech signal segments. The unvoiced portion of each time segment is reconstructed by selecting, dependent on the voicing probability Pv, of a codebook entry which comprises a high pass filtered noise signal. The codebook entries can be obtained from an inverse Fourier transform of the portion of the spectrum determined to be unvoiced by obtaining the spectrum of a white noise signal and then computing the inverse transform of the remaining signal in which low frequency band components have been successively removed. The noise signal is gain adjusted and passed through a synthesis filter having coefficients equal to the LPC coefficients determined in the encoder to reconstruct the unvoiced portion of the speech segment. The voiced portion of the signal is synthesized in the present invention using a phase compensated harmonic synthesizer which provides amplitude and phase continuity to the signal of the preceding speech segment. Specifically, using the harmonic amplitudes vector from the data packet, the phase compensated harmonic synthesizer computes the conditions required to ensure amplitude and phase continuity between adjacent voiced segments. The phases of the harmonic frequencies in the current voiced segment are computed from a set of equations defining the phases of the harmonic frequencies in the previous segment. The amplitudes of the harmonic frequencies are determined from a linear interpolation of the received amplitudes of the current and the previous time segments. Smooth transition between the signals in adjacent speech segments is provided by superimposing such signals which overlap over a prespecified set of samples. Within this overlapping set of samples the signal from the previous frame is linearly reduced to zero, while the signal in the current segment is linearly increased from a zero value to its full amplitude at the end of the overlap set. The reconstructed voiced and unvoiced portions of the signal are combined to provide a composite output speech signal which is a delayed version of the input signal.

Due to the separation of the input signal in different portions, it is possible to use the method of the present invention to develop different processing systems with operating characteristics corresponding to user-specific applications. Furthermore, the system of the present invention can easily be modified to generate a number of voice effects with applications in various communications and multimedia products.

BRIEF DESCRIPTION OF THE DRAWINGS

The invention will be next be described in detail by reference to the following drawings in which.

DETAILED DESCRIPTION OF THE INVENTION

During the course of the description like numbers will be used to identify like elements shown in the figures. Bold face letters represent vectors, while vector elements and scalar coefficients are shown in standard print.

Figure 1:
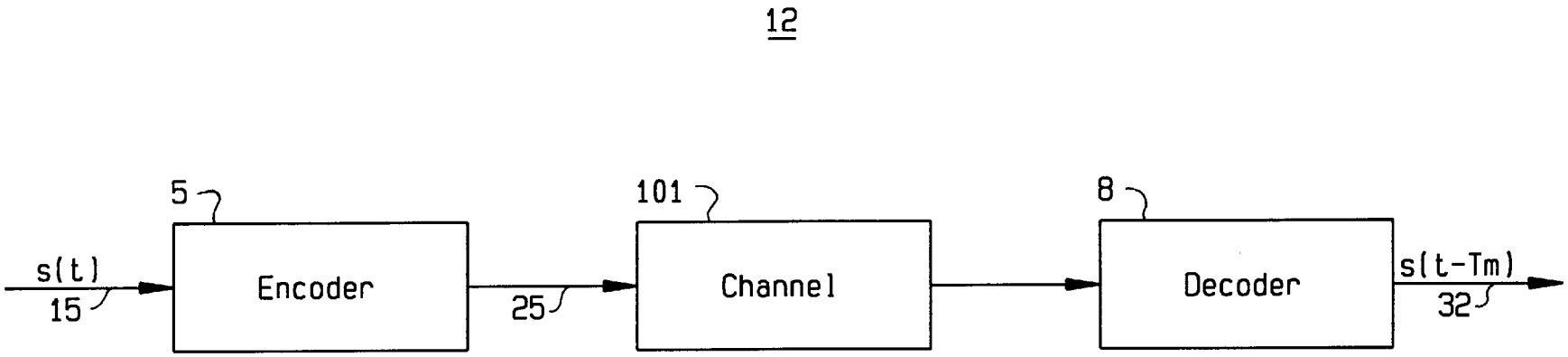
FIG. 1 is a block diagram of the speech processing system of the present invention.

FIG. 1 is a block diagram of the speech processing system 12 for encoding and decoding speech in accordance with the present invention. Analog input speech signal s(t) (15) from an arbitrary voice source is received at encoder 5 for subsequent storage or transmission over a communications channel 101. Encoder 5 digitizes the analog input speech signal 15, divides the digitized speech sequence into speech segments and encodes each segment into a data packet 25 of length I information bits. The ordered sequence of encoded speech data packets 25 which represent the continuous speech signal s(t) are transmitted over communications channel 101 to decoder 8. Decoder 8 receives data packets 25 in their original order to synthesize a digital speech signal which is then passed to a digital-to-analog converter to produce a time delayed analog speech signal 32, denoted s(t–Tm), as explained in more detail next. The system of the present invention is described next with reference to a specific preferred embodiment which is directed to processing of speech at a 11 kHz sampling rate.

A. The Encoder

Figure 2:
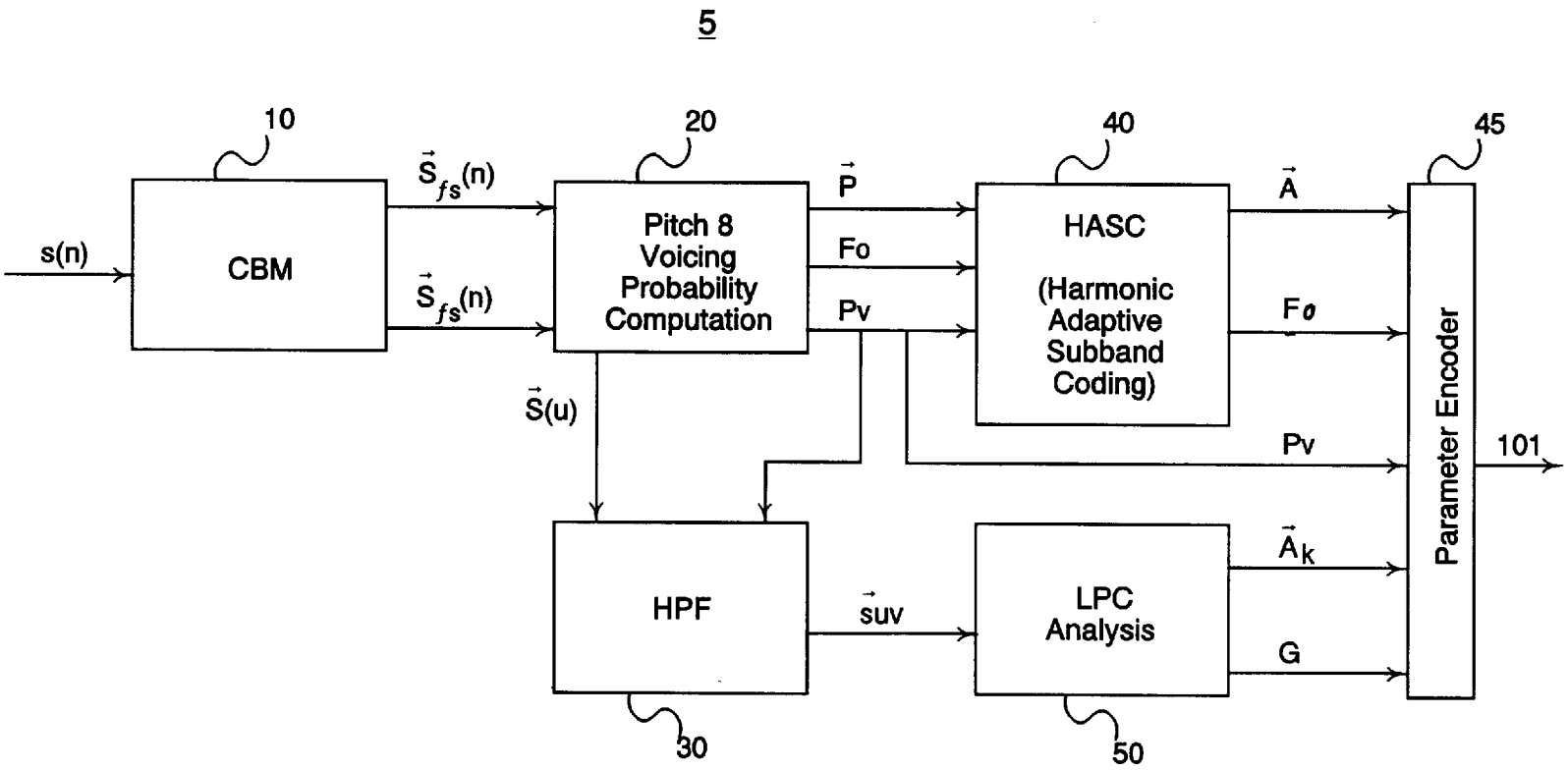
FIG. 2 is a schematic block diagram of the encoder used in a preferred embodiment of the system of the present invention.

FIG. 2 illustrates in greater detail the main elements of encoder 5 and their interconnections for the preferred embodiment of a speech coder operating at 11 kHz. Signal pre-processing is first applied, as known in the art, to facilitate encoding of the input speech. In particular, analog input speech signal 15 is low pass filtered to eliminate frequencies outside the human voice range. The low pass filtered analog signal is then passed to an analog-todigital converter (not shown) where it is sampled and quantized to generate a digital signal s(n) suitable for subsequent processing. The analog-to-digital converter preferably operates at a sampling frequency $f_s$=11 kHz which, in accordance with the Nyquist criterion, corresponds to twice the highest frequency in the spectrum of low pass filtered analog signal s(t). It will be appreciated that other sampling frequencies may be used as long as they satisfy the Nyquist criterion. The signals from buffer manager 10 are then processed in pitch and voicing probability computation block 20.

Block 20 functions to provide to other blocks of the encoder 5 an estimate of the pitch of the signal in the current speech segment. Block 20 also computes and supplies to other system blocks the full spectrum of the input signal, appropriately windowed, as known in the art. Finally, block 20 computes a parameter designated in the sequel as the voicing probability Pv of the segment which generally indicates the portion of the spectrum of the current speech segment that is predominantly voiced. For practical reasons, in accordance with a preferred embodiment of the present invention it is assumed that the voiced signal occupies the lower frequency portion of the spectrum, while the high end portion of the spectrum corresponds to unvoiced speech signal. Thus, in the system of the present invention the voicing probability Pv indicates the boundary, i.e. the point in the spectrum of the signal separating the predominantly voiced and the predominantly unvoiced portions of the signal spectrum. The voiced and unvoiced portions of the signal are then processed separately in different branches of the encoder for optimal signal encoding. Notably, unlike standard subband coding schemes in which the signal is segmented in the frequency domain into bands having fixed boundaries, in accordance with the present invention the separation of the signal into voiced and unvoiced spectrum portions is adaptively adjusted for each signal segment. Experimentally this feature of the present invention has been determined to result in much less subjective distortion of the output signal compared to standard speech coding systems.

The outputs from block 20 are supplied respectively to a voiced processing branch, represented in FIG. 2 as block 40, and unvoiced signal encoding branch which comprises blocks 30 and 50. More specifically, block 30 operates as a high pass filter (HPF) which zeroes the components in the spectrum of the speech segment which are in the voiced spectrum band, i.e. below the frequency boundary determined from the voicing probability Pv. The resulting signal is inverse Fourier transformed to obtain an unvoiced time domain signal vector and is then supplied to LPC analysis block 50 for parameter encoding. Voiced signal encoding block 40 uses the spectrum of the speech segment, the voicing probability Pv and the pitch estimate $F_0$ computed in block 20 to generate a set of harmonically related spectrum amplitudes within the "voiced" band of the signal spectrum.

As shown in FIG. 2, the last block of encoder 5 is parameter encoding block 45 which combines the output of the voiced and the unvoiced processing branches into a sequence of data packets ready for subsequent storage and transmission. The building blocks of the encoder 5 in FIG. 2 are considered individually in more detail next.

Figure 3:
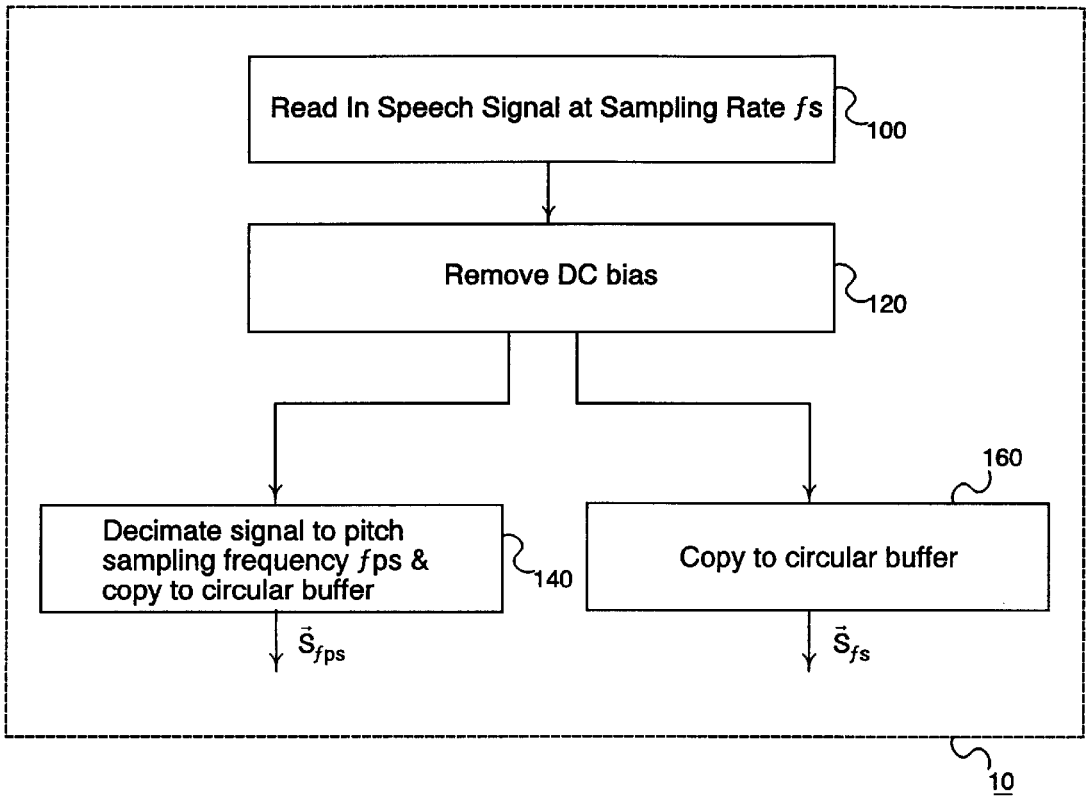
FIG. 3 illustrates in a block-diagram form a preprocessing block of the encoder in FIG. 2.

As shown in FIG. 3, digital input speech signal s(n) is passed to circular buffer manager (CBM) 10, where it is read, in step 100, at the operating sampling frequency $f_s$. The filtered signal is next passed in step 120 through a high pass filter (HPF) which has a cutoff frequency of less than about 100 Hz in order to eliminate any low frequency noise, such as 60 Hz AC voltage interference, and remove any DC bias in the signal.

The filtered signal is next input to a circular buffer in step 160. As known in the art, this buffering can be used to divide the input signal s(n) into time segments of a predetermined length M. In a specific embodiment of the present invention, the length M is selected to be about 305 samples which corresponds to 27.5 msec of speech at an 11 KHz sampling frequency. The lag between adjacent frames is 15 msec or about 165 samples. Dependent on the desired temporal resolution, the delay between time segments can be set to other values, between 0 to 27.5 msec.

Simultaneously, in step 140 signal s(n) is decimated in accordance with a preferred embodiment of the present invention down to a sampling frequency $f_{ps}$ which is adequate for the determination of the pitch $F_0$. of the signal within the time segment. The "pitch sampling" frequency $f_{ps}$ is selected in the range of about 3 to 8 kHz so that the lower end corresponds to about a 1 kHz highest expected pitch frequency. The use of a relatively low sampling frequency for pitch estimation has been determined to be computationally efficient and also results in a better resolution in the frequency domain.

Referring back to FIG. 2, pitch and voicing probability computation block 20 is next used to estimate the pitch $F_0$ of the current time segment and also to estimate the portion of the speech segment which can be classified as voiced, i.e. to estimate the voicing probability Pv for the segment. Speech is generally classified as voiced if a fundamental frequency is imported to the air stream by the vocal cords of the speaker. In such case the speech signal is usually modeled as a superposition of sinusoids which are harmonically related to the fundamental frequency. The determination as to whether a speech segment is voiced or unvoiced, and the estimation of the fundamental frequency can be obtained in a variety of ways known in the art as pitch detection algorithms.

1. Pitch and Voicing Probability Computation

Figure 4:
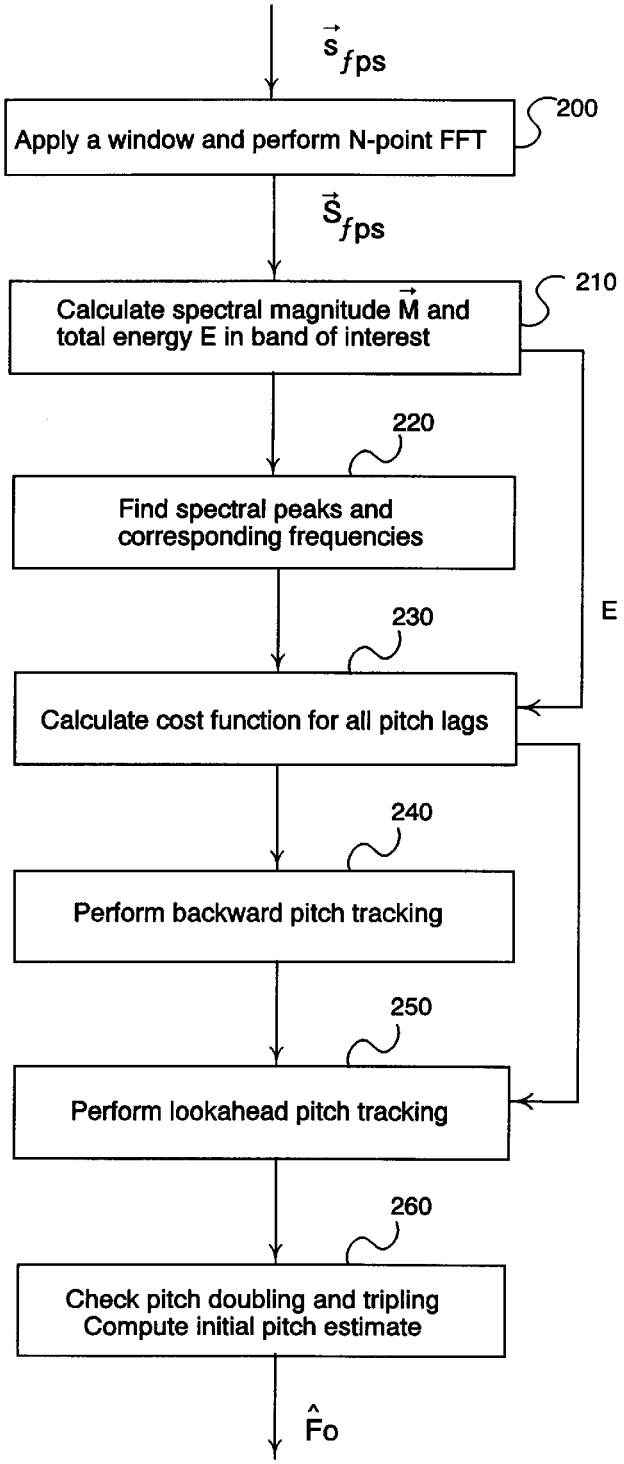
FIG. 4 is a flow-chart of the pitch detection algorithm in accordance with a preferred embodiment of the present invention.

Turning next to FIG. 4, it shows a flow-chart of the pitch detection algorithm in accordance with a preferred embodiment of the present invention. Pitch detection plays a critical role in most speech coding applications, especially for low bit rate systems, because the human ear is more sensitive to changes in the pitch compared to changes in other speech signal parameters by an order of magnitude. Typical problems include mistaking submultiples of the pitch for its correct value in which case the synthesized output speech will have multiple times the actual number of harmonics. The perceptual effect of making such a mistake is having a male voice sound like female. Another significant problem is ensuring smooth transitions between the pitch estimates in a sequence of speech frames. If such transitions are not smooth enough, the produced signal exhibits perceptually very objectionable signal discontinuities. Therefore, due to the importance of the pitch in any speech processing system, its estimation requires a robust, accurate and reliable computation method. Several algorithms have been used in the past to this end.

A large class of pitch detectors are based on time domain methods which generally attempt to detect long term waveform similarities by using various techniques, among which the autocorrelation method and the average magnitude difference function are most widely used. Another class of pitch detectors are based on frequency domain analysis of the speech signal in which the harmonic structure of the signal is detectable directly, and the main problem is to estimate the exact locations of the peaks on a sufficiently fine grid of spectral lines, without unduly increasing the complexity of the detector. In accordance with a preferred embodiment of the present invention the pitch detector used in block 20 of the encoder 5 operates in the frequency domain.

Accordingly, with reference to FIG. 2, the first function of block 20 in the encoder 5 is to compute the signal spectrum S(k) for a speech segment, also known as the short time spectrum of a continuous signal, and supply it to the pitch detector (as well as both the voiced and unvoiced signal processing branches of the encoder, as described in more detail next). The computation of the short time signal spectrum is a process well known in the art and therefore will be discussed only briefly in the context of the operation of encoder 5.

Specifically, it is known in the art that to avoid discontinuities of the signal at the ends of speech segments and problems associated with spectral leakage in the frequency domain, a signal vector $Y_M$ containing samples of a speech segment should be multiplied by a pre-specified window w to obtain a windowed speech vector $Y_{WM}$. The specific window used in the encoder 5 of the present invention is a Hamming or a Kaiser window, the elements of which are scaled to meet the constraint:

$$1 = \frac{1}{M} \sum_{m=0}^{M-1} w^2(m) \tag{1}$$

The use of Kaiser and Hamming windows is described for example in Oppenheim et al., "Discrete Time Signal Processing," Prentice Hall, Englewood Hills, N.J., 1989. For a Kaiser window $W_k$ elements of vector $Y_{WM}$ are given by the expression:

$$Y_{WM}(n)=W_K(n)\cdot Y(n);\ n-0,2,\ldots,M-1 \tag{2}$$

The input windowed vector $Y_{wm}$ is next padded with zeros to generate a vector $Y_N$ of length N defined as follows:

$$\begin{aligned} y_N(n) &= y_{WM}(n) \text{ for } n = 0,\ldots,M-1 \\ &= 0 \text{ for } n = M,\ldots,N-1 \end{aligned} \tag{3}$$

The zero padding operation is required in order to obtain an alias-free version of the discrete Fourier transform (DFT) of the windowed speech segment vector, and to obtain spectrum samples on a more finely divided grid of frequencies. It can be appreciated that dependent on the desired frequency separation, a different number of zeros may be appended to windowed speech vector $Y_{WM}$.

Following the zero padding, a N point discrete Fourier transform of speech vector $Y_N$ is performed to obtain the corresponding frequency domain vector $F_N$. Preferably, the computation of the DFT is executed using any fast Fourier transform (FFT) algorithm. As well known, the efficiency of the FFT computation increases if the length N of the transform is a power of 2, i.e. if $N=2^L$. Accordingly, in a specific embodiment of the present invention the length N of the speech vector is initially adjusted by adding zeros to meet this requirement. In a specific implementation of the encoder 5 in accordance with the present invention the transform length N is selected to be N=512. For reasons to be discussed in more detail next, in block 20 two spectrum estimates of equal length N of the input signal are obtained, using the input signals shown in FIG. 2, which are sampled at the regular sampling frequency $f_S$ and the "pitch sampling" frequency $f_{ps}$, respectively.

In accordance with a preferred embodiment of the present invention the pitch and the voicing probability Pv of a speech segment are computed in a single block 20 but for clarity of the discussion the processing algorithms used in each case are considered separately in the following sections.

1.1. Pitch Estimation

In accordance with a preferred embodiment of the present invention estimation of the pitch generally involves a two-step process. In the first step, the spectrum of the input signal $S_{fps}$ sampled at the "pitch rate" $f_{ps}$ is used to compute a rough estimate of the pitch $F_0$. In the second step of the process the pitch estimate is refined using a spectrum of the signal sampled at the regular sampling frequency $f_s$. Preferably, the pitch estimates in a sequence of frames are also refined using backward and forward tracking pitch smoothing algorithms which correct errors for each pitch estimate on the basis of comparing it with estimates in the adjacent frames. In addition, the voicing probability Pv of the adjacent segments, discussed in more detail in Section 2, is also used in a preferred embodiment of the invention to define the scope of the search in the pitch tracking algorithm.

More specifically, with reference to FIG. 4, at step 200 of the method an N-point FFT is performed on the signal sampled at the pitch sampling frequency $f_{ps}$. As discussed above, prior to the FFT computation the input signal of length N is windowed using preferably a Kaiser window of length N. In the illustrative embodiment of the system of the present invention using an 8 kHz pitch sampling frequency 221 points are used for each speech segment for a 512-point FFT computation.

In the following step 210 are computed the spectral magnitudes M and the total energy E of the spectral components in a frequency band in which the pitch signal is normally expected. Typically, the upper limit of this expectation band is assumed to be between about 1.5 to 2 kHz. Next, in step 220 are determined the magnitudes and locations of the spectral peaks within the expectation band by using a simple routine which computes signal maxima. The estimated peak amplitudes and their locations are designated as $\{A_i, W_i\}^L_{i=I}$ respectively where L is the number of peaks in the expectation band.

The search for the optimal pitch candidate among the peaks determined in step 220 is performed in the following step 230. Conceptually, this search can be thought of as defining for each pitch candidate of a comb-filter comprising the pitch candidate and a set of harmonically related amplitudes. Next, the neighborhood around each harmonic of each comb filter is searched for an optimal peak candidate.

Specifically, within a pre-specified search distance d around the harmonics of each pitch candidate, the maxima of the actual speech signal spectrum are checked to determine the optimum spectral peak. A suitable formula used in accordance with the present invention to compute the optimum peak is given by the expression:

$$e_k = A_i \cdot d(w_i, kw_o) \tag{4}$$

where $e_k$ is weighted peak amplitude for the k-th harmonic; $A_i$ is the i-th peak amplitude and $d(W_i, kw_o)$ is an appropriate distance measure between the frequency of the i-th peak and the k-th harmonic within the search distance. A number of functional expressions can be used for the distance measure $d(W_i, kw_o)$. Preferably, two distance measures, the performance of which is very similar, can be used:

$$1:\ d(w_i, kw_o) = \cos[2\pi(w_i - kw_o)] \tag{5}$$

$$2:\ d(w_i, kw_o) = \frac{\sin[2\pi(w_i - kw_o)]}{2\pi(W_i - kw_o)} \tag{6}$$

In accordance with the present invention the determination of an optimum peak depends both on the distance function $d(W_i, kw_o)$ and the peak amplitudes within the search distance. Therefore, it is conceivable that using such function an optimum can be found which does not correspond to the minimum spectral separation between a pitch candidate and the spectrum peaks.

Once all optimum peak amplitudes corresponding to each harmonic of the pitch candidates are obtained, a normalized cross-correlation function is computed between the frequency response of each comb-filter and the determined optimum peak amplitudes for a set of speech frames in accordance with the expression:

$$R_{Fr}(n) = \frac{\sum_{k=i}^{H} (h_k \cdot e_k)}{\sum_{i=1}^{L} A_i^2} - \frac{1}{2} \cdot \frac{\sum_{k=1}^{H} h_k^2}{\sum_{i=1}^{L} A_i^2} \tag{7}$$

where $-2 \leqq Fr-3$ and hk are the harmonic amplitudes of the teeth of comb-filter, H is the number of harmonic amplitudes, and n is a pitch lag which varies between about 16 and 125 samples in the specific embodiment. The second term in the equation above is a bias factor, an energy ratio between harmonic amplitudes and peak amplitudes, that reduces the probability of encountering a pitch doubling problem.

The pitch of frame $Fr_1$ is estimated using backward and forward pitch tracking to maximize the cross-correlation values from one frame to another which process is summarized as follows: blocks 240 and 250 in FIG. 4 represent respectively backward pitch tracking and lookahead pitch tracking which can in be used in accordance with a preferred embodiment of the present invention to improve the perceptual quality of the output speech signal. The principle of pitch tracking is based on the continuity characteristic of the pitch, i.e. the property of a speech signal that once a voiced signal is established, its pitch varies only within a limited range. (This property was used in establishing the search range for the pitch in the next signal frame, as described above). Generally, pitch tracking can be used either as an error checking function following the main pitch determination process, or as a part of this process which ensures that the estimation follows a correct, smooth route, as determined by the continuity of the pitch in a sequence of adjacent speech segments. Algorithms for pitch tracking are known in the prior art and will not be considered in detail. Useful discussion of this topic can be found, for example, in A. M. Kondoz, "Digital Speech: Coding for Low Bit Rate Communication Systems," John Wiley & Sons, 1994, the relevant portions of which are hereby incorporated by reference for all purposes.

Finally, in step 260 in FIG. 4 a check is made whether the estimated pitch is not in fact a submultiple of the actual pitch.

1.1.1. Pitch Sub-Multiple Check

The sub-multiple check algorithm in accordance with the present invention can be summarized as follows:

1. Integer and sub-multiples of the estimated pitch are first computed to generate the ordered list $$\left(\frac{P_1}{2}, \frac{P_1}{3}, \ldots, \frac{P_1}{n}\right)$$

2. The average harmonic energy for each sub-multiple candidate is computed using the expression:

$$E(w_k) = \frac{1}{L_k} \sum_{i=1}^{L_k} A^2(i \cdot w_k);\ k = 1, 2, \ldots, n \tag{9}$$

where $L_k$ is the number of harmonics, $A(i \cdot W_k)$ are harmonic magnitudes and $$w_k = \frac{2\pi}{P_{1/k}}$$

is the frequency of the $k^{th}$ sub-multiple of the pitch. The ratio between the energy of the smallest sub-multiple and the energy of the first sub-multiple, $P_1$, is then calculated and is compared with an adaptive threshold which varies for each sub-multiple. If this ratio is larger than the predetermined threshold, the sub-multiple candidate is selected as the actual pitch. Otherwise, the next largest sub-multiple is checked. This process is repeated until all sub-multiples have been tested.

3. If none of the sub-multiples of the pitch satisfy the condition in step 2, the ratio r given in the following expression is computed.

$$r = \frac{R_1\left(\frac{P_1}{k}\right)}{R_1(P_1)}\ ;\ k = 2, 3, \ldots, n \tag{10}$$

The ratio r is then compared with another adaptive threshold which varies for each sub-multiple. If r is larger than the corresponding threshold, it is selected as the actual pitch, otherwise, this process is iterated until all sub-multiples are checked. If none of the sub-multiples of the initial pitch satisfy the condition, then $P_1$. is selected as the pitch estimate.

1.1.2. Pitch Smoothing

In accordance with a preferred embodiment of the present invention the pitch is estimated at least one frame in advance. Therefore, as indicated above, it is a possible to use pitch tracking algorithms to smooth the pitch $P_o$ of the current frame by looking at the sequence of previous pitch values ($P_{-2}$, $P_{-1}$) and the pitch value ($P_1$) for the first future frame. In this case, if $P_{-2}$, $P_{-1}$ and $P_1$ are smoothly varied from one to another, any jump in the estimate of the pitch $P_o$, of the current frame away from the path established in the other frames indicates the possibility of an error which may be corrected by comparing the estimate $P_o$ to the stored pitch values of the adjacent frames, and "smoothing" the function which connects all pitch values. Such a pitch smoothing procedure which is known in the art improves the synthesized speech significantly.

While the pitch detection was described above with reference to a specific preferred embodiment which operates in the frequency domain, it should be noted that other pitch detectors can be used in block 20 to estimate the fundamental frequency of the signal in each segment. Specifically, an autocorrelation or average magnitude difference function (AMDF) detectors that operate in the time domain, or a hybrid detector that operates both in the time and the frequency domain can be also be employed for that purpose. Furthermore, encoder 5 of the system may also include a pre-processing stage to further improve the performance of the speech detector. For example, as known in the art, it is frequently desirable to remove the formant structure from the signal prior to the step of estimating the pitch to improve the accuracy of the estimate. Removing the formant structure in speech signals is referred as spectrum flattening and can be accomplished, for example, using an LPC inverse filter. Thus, with reference to FIG. 2, a separate block can be inserted between buffer 10 and block 20, functioning to flatten the spectrum of the input signal.

1.2. Voicing Determination

Traditional speech processing algorithms classify each speech frame either as purely voiced or unvoiced based on some prespecified fixed decision threshold. Recently, in multiband excitation (MBE) vocoders, the speech spectrum of the signal was modeled as a combination of both unvoiced and voiced portions of the speech signal by dividing the speech spectrum into a number of frequency bands and making a binary voicing decision for each band. In practice, however, this technique is inefficient because it requires a Large number of bits to represent the voicing information for each band of the speech spectrum. Another disadvantage of this multiband decision approach is that since the voicing determination is not always accurate and voicing errors, especially when made in low frequency bands, can result in output signal buzziness and other artifacts which are perceptually objectionable to listeners.

In accordance with the present invention, a new method is proposed for representing voicing information efficiently. Specifically, in a preferred embodiment of the method it is assumed that the low frequency components of a speech signal are predominantly voiced and the high frequency components are predominantly unvoiced. The goal is then to find a border frequency that separates the signal spectrum into such predominantly low frequency components (voiced speech) and predominantly high frequency components (unvoiced speech). It should be clear that such border frequency changes from one frame to another. To take into account such changes, in accordance with a preferred embodiment of the present invention the concept of voicing probability Pv is introduced. The voicing probability Pv generally reflects the amount of voiced and unvoiced components in a speech signal. Thus, for a given signal frame Pv=0 indicates that there are no voiced components in the frame; Pv=1 indicates that there are no unvoiced speech components; the case when Pv has a value between 0 and 1 reflects the more common situation in which a speech segment is composed of a combination of both voiced and unvoiced signal portions, the relative amounts of which are expressed by the value of the voicing probability Pv.

In accordance with a preferred embodiment of the present invention the voiced and unvoiced portions of the signal which are determined on the basis of the voicing probability are processed separately in different branches of the encoder for optimal signal encoding. Notably, unlike standard subband coding schemes in which the signal is segmented in the frequency domain into bands having fixed boundaries, in accordance with the present invention the separation of the signal into voiced and unvoiced spectrum portions is flexible and adaptively adjusted for each signal segment.

1.2.1. Computation of the Voicing Probability

Figure 5:
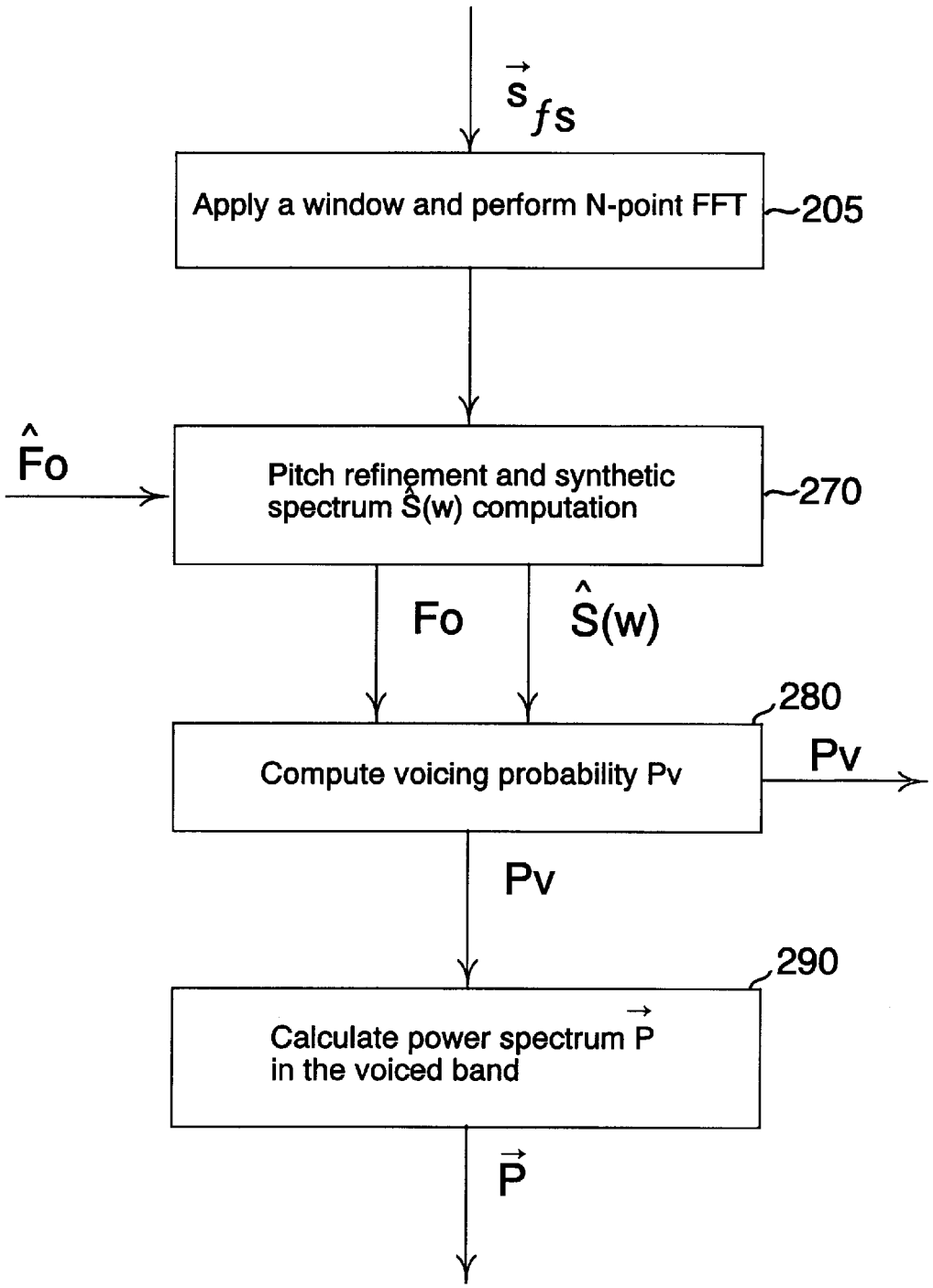
FIG. 5 is a flow-chart of the voicing probability computation algorithm of the present invention.

With reference to FIG. 5, the determination of the voicing probability, along with a refinement of the pitch estimate computed at the "pitch sampling" frequency $f_{ps}$, is accomplished as follows. In step 205 of the method, the spectrum of the speech segment at the standard sampling frequency $f_s$ is computed using an N-point FFT.

In the next block 270 the following method steps take place. First, a set of pitch candidates are selected on a refined spectrum grid about the initial pitch estimate. In a preferred embodiment, about 10 different candidates are selected within the frequency range P−1 to P=1 of the initial pitch estimate P. The corresponding harmonic coefficients $A_i$ for each of the refined pitch candidates are determined next from the signal spectrum $S_{fs}(k)$ and are stored. Next, a synthetic speech spectrum is created about each pitch candidate based on the assumption that the speech is purely voiced. The synthetic speech spectrum S(w) can be computed as:

$$\hat{s}(w) = \sum_{k=1}^{H} |s(kw_o)| \cdot \mathrm{sinc}(w - kw_o) \tag{11}$$

where $|S(k\omega_0)|$is the original speech spectrum magnitude sampled at the harmonics of the pitch $F_0$, H is the number of harmonics and:

$$sinc(w - kw_o) = \frac{\sin[2\pi(w - kw_o)]}{2\pi(w - kw_o)} \tag{12}$$

is a sinc function which is centered around each harmonic of the fundamental frequency.

The original and synthetic excitation spectra corresponding to each harmonic of fundamental frequency are then compared on a point-by-point basis and an error measure for each value is computed and stored. Due to the fact that the synthetic spectrum is generated on the assumption that the speech is purely voiced, the normalized error will be relatively small in frequency bins corresponding to voiced harmonics, and relatively large in frequency bins corresponding to unvoiced portions of the signal. Thus, in accordance with the present invention the normalized error for the frequency bin around each harmonic can be used to decide whether the signal in a bin is predominantly voiced or unvoiced. To this end, the normalized error for each harmonic bin is compared to a frequency-dependent threshold. The value of the threshold is determined in a way such that a proper mix of voiced and unvoiced energy can be obtained. The frequency-dependent, adaptive threshold can be calculated using the following sequence of steps:

1. Compute the energy of a speech signal.
2. Compute the long term average speech signal energy using the expression:

$$Z_{avg}(n) = \begin{cases} \dfrac{[z_0(n) + z_{avg}(n-1)]}{2.0}; & z_0(N) > Z_{avg}(n-1) \\ \alpha \cdot Z_{avg}(n-1) + \beta Z_0(n); & \text{otherwise} \end{cases}$$

where $Z_0(n)$ is the energy of the speech signal.

3. Compute the threshold parameter using the expression:

$$T_c = \frac{(\gamma \cdot Z_{avg}(n) + z_0(n))}{(\mu \cdot Z_{avg}(n) + z_0(n))} \tag{13}$$

4. Compute the adaptive, frequency dependent threshold function:

$$T_a(W) = T_c \cdot [a \cdot w = b] \tag{14}$$

where the parameters a, α, β, γ, μ, a and b are constants that can be determined by subjective tests using a group of listeners which can indicate a perceptually optimum ratio of voiced to unvoiced energy. In this case, if the normalized error is less than the value of the frequency dependent adaptive threshold function, $T_a$ (w), the corresponding frequency bin is then determined to be voiced; otherwise it is treated as being unvoiced.

In summary, in accordance with a preferred embodiment of the present invention the spectrum of the signal for each segment is divided into a number of frequency bins. The number of bins corresponds to the integer number obtain by computing the ratio between half the sampling frequency $f_s$. and the refined pitch for the segment estimated in block 270 in FIG. 5. Next, a synthetic speech signal is generated on the basis of the assumption that the signal is completely voiced, and the spectrum of the synthetic signal is compared to the actual signal spectrum over all frequency bins. The error between the actual and the synthetic spectra is computed and stored for each bin and then compared to a frequencydependent adaptive threshold obtained in Eq. (14). Frequency bins in which the error exceeds the threshold are determined to be unvoiced, while bins in which the error is less than the threshold are considered to be voiced.

Unlike prior art solutions in which each frequency bin is processed on the basis of the voiced/unvoiced decision, in accordance with a preferred embodiment of the present invention the entire signal spectrum is separated into two bands. It has been determined experimentally that usually the low frequency band of the signal spectrum represents voiced speech, while the high frequency band represents unvoiced signal. This observation is used in the system of the present invention to provide an approximate solution to the problem of separating the signal into voiced and unvoiced bands, in which the boundary between voiced and unvoiced spectrum bands is determined by the ratio between the number of voiced harmonics within the spectrum of the signal and the total number of frequency harmonics, i.e. using the expression:

$$P_v = \frac{H_v}{H} \tag{15}$$

where $H_v$, is the number of voiced harmonics that are estimated using the above procedure and H is the total number of frequency harmonics for the entire speech spectrum. Accordingly, the voicing cut-off frequency is then computed as:

$$W_c = P_v \cdot \pi \tag{16}$$

which defines the border frequency that separates the unvoiced and voiced portion of speech spectrum. The voicing probability Pv is supplied on output to block 280 in FIG. 5. Finally, in block 290 in FIG. 5 is computed the power spectrum $P_v$ of the harmonics within the voiced band of the signal spectrum. Power spectrum vector $P_v$ is used in the voiced signal analysis block 40, as discussed in more detail next.

2. Encoding of the Unvoiced Signal Portion

Figure 7:
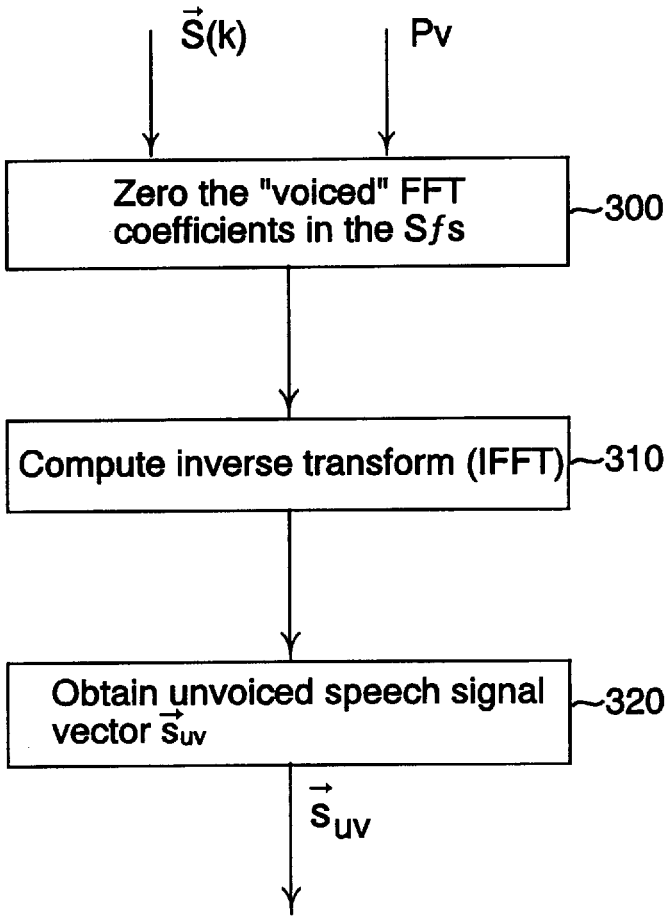
FIG. 7 illustrates the high pass filtering method used in the present invention to separate the unvoiced portion of the speech segment.

With reference to FIGS. 2 and 7, the unvoiced portion of the signal spectrum is obtained using a high pass filtered version of the signal spectrum S(k) obtained in computation block 20. Specifically, in a preferred embodiment of the present invention the spectrum coefficients which are within the "voiced" band of the spectrum, as indicated by the voicing probability estimate Pv, are zeroed out in step 300. In step 310 the inverse Fourier transform of the remaining spectrum components is computed to obtain, in step 320, a time domain signal vector $S_{uv}$ which is now separate from the signal s(n) in the original speech segment. Unvoiced signal vector $S_{uv}$ is next supplied to LPC analysis block 50 for determination of its linear prediction coding parameters.

Figure 8:
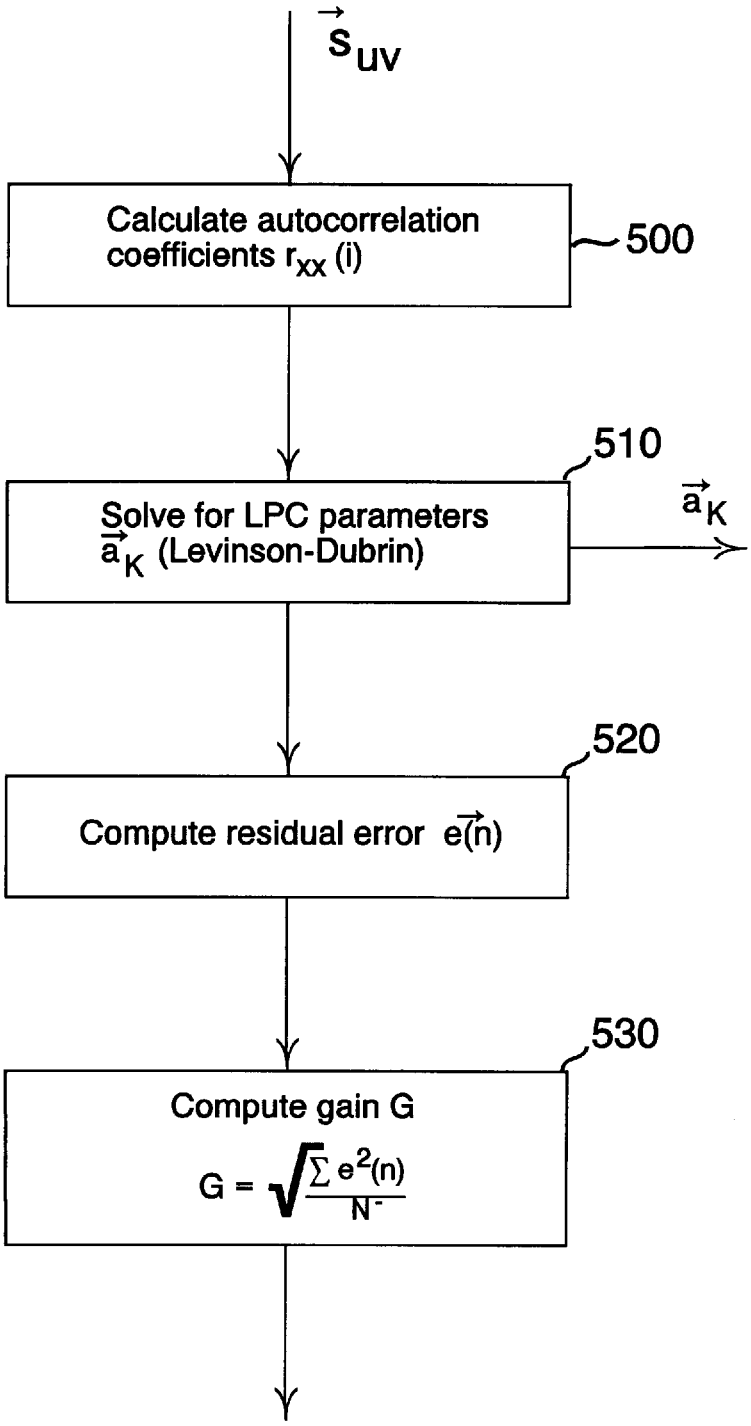
FIG. 8 shows in a flow-chart form the computation of the coding parameters of the unvoiced portion of a speech segment.

In particular, with reference to FIG. 2, signal vector $S_{uv}$ is next applied to block 50 for calculating the linear prediction coding (LPC) coefficients which model the human vocal tract for the generation of the unvoiced portion of the speech signal. As known in the art, in linear predictive coding the current signal sample s(n) is represented by a combination of the P preceding samples s(n–i), (i=1, . . . , P) multiplied by the LPC coefficients, plus a term which represents the prediction error. Thus, in the system of the present invention, the current sample s(n) is modeled using the auto-regressive model:

$$s(n)=e_n-a_1s(n^-1)-a_2s(n-2)- \ldots -a_Ps(n-P) \quad (17)$$

where $a_1, \ldots, a_p$ are the LPC coefficients and $e_n$ is the prediction error for the current sample. The vector of unknown LPC coefficients $a_k$, which minimizes the variance of the prediction error is determined by solving a system of linear equations, as known in the art. To this end, in step 500 in FIG. 8 the autocorrelation coefficients $r_{xx}(i)$ of the unvoiced signal vector $S_{uv}$ are computed. A computationally efficient way to solve for the LPC coefficients is next used in step 510, as given by the Levinson-Durbin algorithm described, for example, in S. J. Orphanidis, "Optimum Signal Processing," McGraw Hill, New York, 1988, pp. 202–207, which is hereby incorporated by reference. In a preferred embodiment of the present invention the number P of the preceding speech samples used in the prediction is set equal to about 6 to 10. The LPC coefficients calculated in block 510 are loaded into output vector $a_k$. In the following step 520 is computed the residual error sequence e(n). Additionally, block 530 outputs the prediction error power or the filter gain G for the unvoiced speech segment.

In a preferred embodiment of the present invention the LPC coefficients representing the unvoiced portion of the spectrum of the signal are then transformed to line spectrum coefficients (LSF). Generally, LSFs encode speech spectral information in the frequency domain and have been found to be less sensitive to quantization than the LPC coefficients. In addition, LSFs lend themselves to frame-to-frame interpolation with smooth spectral changes because of their close relationship with the formant frequencies of the input signal. This feature of the LSFs is used in the present invention to increase the overal coding efficiency of the system because only the difference between LSF coefficient values in adjacent frames need to be transmitted in each segment. The LSF transformation is known in the art and will not be considered in detail here. For additional information on the subject one can consult, for example, Kondoz, "Digital Speech: Coding for Low Bit Rate Communication Systems," John Wiley & Sons, 1994, the relevant portions of which are hereby incorporated by reference.

The elements of the quantized vector of output LSF parameters are finally supplied to parameter encoder 45 to form part of a data packet representing the speech segment for storage and transmission.

The unvoiced signal processing branch (30 and 50) in the encoder 5 in FIG. 2 has been described with reference to a specific preferred embodiment. It should be noted, however, that other specific embodiments can be used in the alternative. Thus, for example, instead of generating the unvoiced portion of the speech signal as the inverse Fourier transform of the high frequency band of the speech spectrum, as shown in the description of block 30 above, the unvoiced portion of the signal can be obtained in the time domain by filtering the input signal with a time-varying high pass filter, the cutoff frequency of which is adjusted in accordance with the computed voicing probability Pv. Furthermore, as known in the art, instead of using LPC analysis, block 50 of the encoder can also be implemented using a standard coder, such as DPCM, ADPCM, CELP, VSELP or others.

3. Encoding of the Voiced Signal Portion

With reference to FIG. 2, in accordance with the present invention, processing of the voiced portion of speech segments is executed in harmonic adaptive subband coding (HASC) block 40. The voiced portion of a speech segment which covers a Pv portion of the signal spectrum is modeled as a superposition of H harmonics which are within the voiced region and is expressed mathematically as follows:

$$\begin{aligned} s_N(n) &= \sum_{h=0}^{H-1} A_H(h) \cdot \sin\left(2\pi(h+1)\frac{f_0}{f_s}\, n + \theta_h\right) + z_n; \\ n &= 0, 1, 2, \ldots, N-1 \end{aligned} \quad (19)$$

where $A_H(h)$ is the amplitude corresponding to the h-th harmonic, $\theta_h$ is the phase of the h-th harmonic, $F_0$ and $f_s$ are the fundamental and the sampling frequencies respectively, $Z_n$ is unvoiced noise and N is the number of samples in the speech segment.

In accordance with the present invention the amplitudes of the harmonics are obtained from the spectrum S(k) which is computed in block 20. The estimated amplitudes are used as elements of a harmonic amplitude vector $A_H$ which is next supplied to parameter encoding block 45 to form part of a data packet that represents the composite signal of a speech segment.

Figure 6:
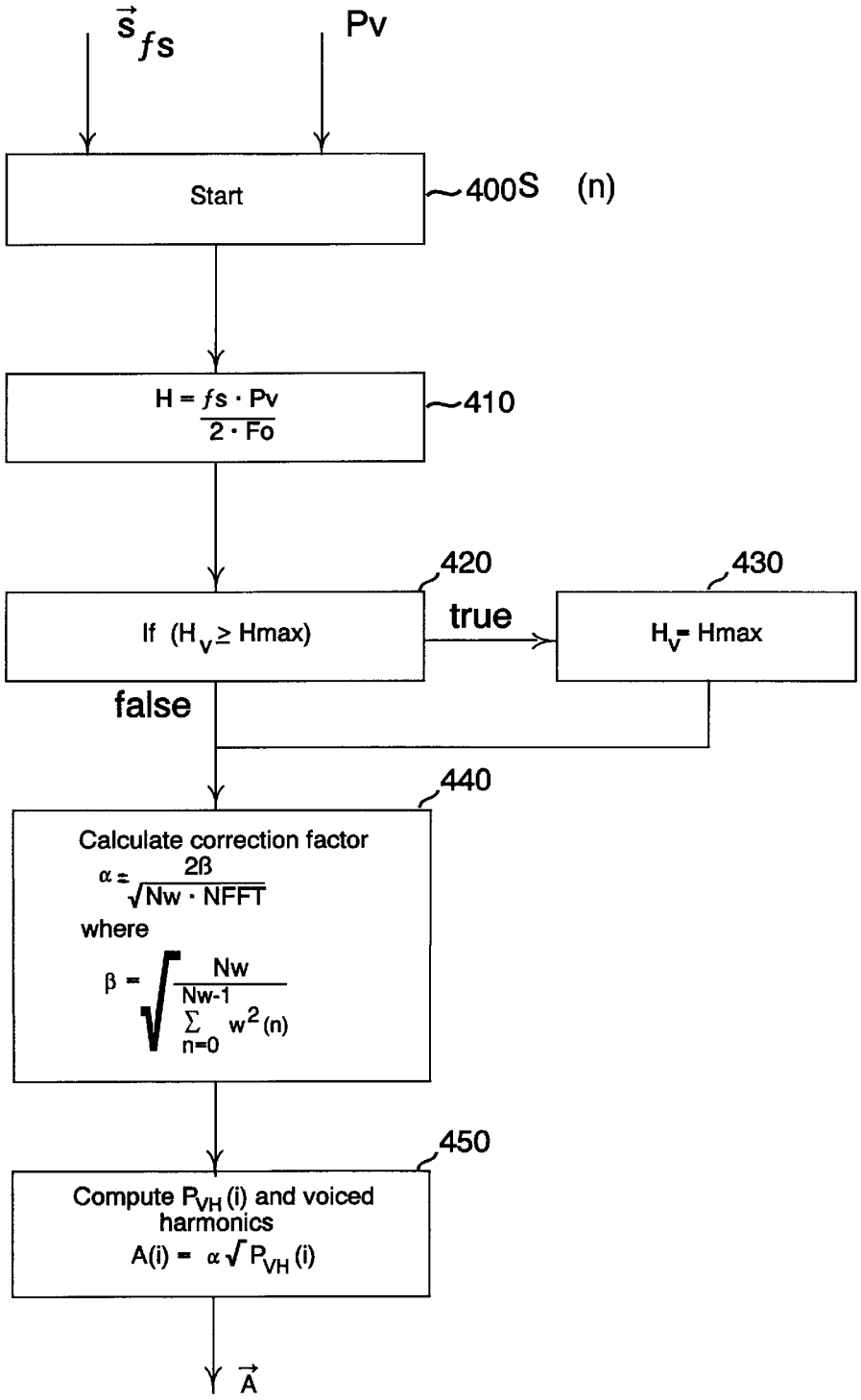
FIG. 6 illustrates in a block-diagram form the operation of the HASC block for encoding voiced portions of the speech segment in accordance with a preferred embodiment of the present invention.

The operation of the HASC block 40 is described in greater detail in FIG. 6. In step 400 the algorithm receives the full spectrum of the signal S(k) and the voicing probability Pv. Next, step 410 is executed to determine the total number of voiced harmonics Hv which is set equal to the integer number obtained by dividing the sampling frequency $f_s$ by twice the fundamental frequency $F_0$ and multiplied by the voicing probability Pv. In order to adequately represent a voiced speech segment while keeping the required bit rate low, in the system of the present invention a maximum number of harmonics $H_{max}$ is defined and, in a specific embodiment, is set equal to 31.

In step 420 it is determined whether the number of harmonics H computed in step 410 is greater than or equal to the maximum number of harmonics $H_{max}$ and, if true, in step 430 the number of harmonics H is set equal to Hmax. In the following step 440 a correction factor a is computed to take into account the effects of the window function used in the computation of the signal spectrum in block 20. With reference to the notations in step 440 in FIG. 6, $N_W$ is the length of the window function used. In a specific embodiment directed to a 11 kHz system the window length is chosen about 305 samples. $N_{FFT}$ indicates the length of the FFT used, and $W_i$ are the window coefficients.

A simple mathematical routine which can be used to determine in step 450 the desired harmonic amplitudes from the elements of the power vector $P_{VH}(i)$ of the voiced harmonics powers is expressed in a programming language as follows:

$$\begin{aligned} &\text{for } i=1: H_v \\ &Fi=i*F_o \\ &\text{for } j=-B(F_0): B(F_0) \\ &P_{VH}(i)=\text{sum } P(Fi+j) \end{aligned} \quad (20)$$

where $H_v$ is the number of harmonics in the voiced band of the signal; Fi is the i-th harmonic of the fundamental frequency $F_0$; B is the spread of signal power about the harmonic frequency due to the window function used in the computation of the signal spectrum; and $P_{VH}(i)$ is the power of the i-th harmonic frequency which is defined as the square of the corresponding complex harmonic spectrum component. The last two entries are explained in more detail in the following paragraphs.

Once the harmonic amplitudes $A_H$ are determined, the accuracy of the computation can be measured using the following mathematical expression:

$$E(h) = \frac{|A_H(h, F_o) - \hat{A}_H(h, F_o)|}{|A_H(h, F_o)|} \cdot 100\%; \quad \text{for } h = 0, \ldots, H-1. \tag{21}$$

Experimental results indicate that block 40 of the encoder of the present invention is capable of providing an estimated sequence of harmonic amplitudes $A_H(h,F_o)$ accurate to within 1000-th of a percent. It has also been found that for a higher fundamental frequency $F_o$ the percent error over the total range of harmonics can be reduced even further.

To provide a more complete understanding of the harmonic amplitude computation process outlined above it should be noted that the amplitudes of the harmonic frequencies of the speech segment can be represented mathematically using the formula:

$$A_H(h, F_o) = \left[ \frac{4}{N \sum_{n=0}^{Nw-1} W^2(n)} \cdot \sum_{k=\left[(h+1)\frac{F_o}{f_s} N\right]-Bw(F_o)}^{\left[(h+1)\frac{F_o}{f_s} N\right]+Bw(F_o)} \left[ \sum_{n=0}^{N-1} s_{Nw}(n) w_{Nw}(n) \cdot e^{-j2\pi \frac{k}{N} \cdot n} \right]^2 \right]^{\frac{1}{2}};$$

$$h = 0, 1, 2, \ldots, H-1; \quad H \leqq \left[ \frac{f_s Pv}{2F_o} \right] \tag{22}$$

where $A_h(h,F_0)$ is the estimated amplitude of the h-th harmonic frequency, $F_0$ is the fundamental frequency of the segment; $B_W(F_0)$ is the half bandwidth of the main lobe of the Fourier transform of the window function; $W_{Nw}(n)$ is a windowing function of length Nw; and $S_{Nw}(n)$ is a speech signal of length Nw.

Considering Eq. (22) in detail it should be noted that the expression within the inner square brackets corresponds to the DFT $F_N$ of the windowed vector $Y_{N=SNw}W_{Nw}$ which is computed in block 20 of the encoder and is defined as:

$$F(k) = \sum_{n=0}^{N-1} y_N(n) e^{-j2\pi \frac{k}{N} \cdot n} \tag{23}$$

Multiplying each resulting DFT frequency sample F(k) by its complex conjugate quantity $F^*(k)$ gives the power spectrum P(k) of the input signal at the given discrete frequency sample:

$$P(k) = F(k) \cdot F^*(k) \tag{24}$$

which operation is mathematically expressed in Eq.(22) by taking the square of the discrete Fourier transform frequency samples F(k). Finally, in Eq.(22) the harmonic amplitude AH (h,FO) is obtained by adding together the power spectrum estimates for the $B_W(F_0)$ adjacent discrete frequencies on each side of the respective harmonic frequency h, and taking the square root of the result, scaling it appropriately.

As indicated above, $B_W(F_0)$ is the half bandwidth of the discrete Fourier transform of the window used in the FFT spectrum computation in block 20 and depends both on the window type and the pitch. Since the windowing operation in block 140 corresponds in the frequency domain to the convolution of the respective transforms of the original speech segment and that of the window function, using all samples within the half bandwidth of the window transform results in an increased accuracy of the estimates for the harmonic amplitudes.

Once the harmonic amplitudes $A_H(h,F_o)$ are computed, in step 450 the sequence of amplitudes is combined into harmonic amplitude vector $A_H$ which is sent to the parameter encoder 45. As known in the art, for quantization purposes it is preferable to transmit a set of normalized amplitudes in order to reduce the dynamic range of the values to be transmitted. To this end, in the system of the present invention each harmonic amplitude is normalized by the sum total of all amplitudes. This last sum which also represents the L1 norm of the harmonic amplitudes of the signal within the segment is also supplied to parameter encoding block 45. Thus, with reference to FIG. 2, parameter encoding block 45 receives on input from pitch detector 20 the voicing probability Pv which determines the portion of the current speech segment which is estimated to be voiced, a gain parameter G which is related to the energy of the error signal in the unvoiced portion of the segment, the quantized LPC coefficients vector $a_k$ (or its corresponding LSF vector, which in a separate preferred embodiment described above could also be codebook vector $X_{VQ}$), the fundamental frequency $F_0$, the vector of normalized harmonic amplitudes $A_H$, and the energy parameter E representing the L1 norm of the harmonic amplitudes.

Parameter encoding block 45 outputs for each speech segment a data packet which contains all information necessary to reconstruct the speech at the receiving end of the system.

The encoding of the voiced portion of the signal has been described with reference to a specific preferred embodiment of HASc encoder block 40. It should be noted, however, that the encoder in the system of the present invention is not limited to this specific embodiment, so that other embodiments can be used for that purpose as well. For example, in another specific embodiment of block 40, a harmonic coder can be used which in addition to amplitude also provides phase information for further transmission and storage. Furthermore, instead of a harmonic coder, other types of coders can be used in block 40 to encode the voiced portion of the speech signal. For example, block 40 can be implemented using a standard LPC vocoder, such a the U.S. Government LPC algorithm standard (LPC-10); a waveform coder, such as adaptive differential PCM (ADPCM); a continuous variable slope delta modulation (CVSDM); or a hybrid type of an encoder, such as the multi-pulse LPC, the multiband excitation (MBE), or an adaptive transform coder, CELP, VSELP or others, as known in the art. The selection of a specific encoder is determined by the type of speech processing application, the required bit rate or other user-specified criteria.

Considering next the operation of parameter encoder block 45, data packets 25 in accordance with a preferred embodiment of the present invention described above have variable length which depends on the voicing probability, on the number of encoded harmonics, the quantization method employed, or others. Generally, the variable length of the data packets implies variable transmission rate for the system. In an alternative preferred embodiment, the system of the present invention has a fixed transmission rate. To this end, a separate buffer can be used following encoder block 45, functioning to equalize the output transmission rate. Such rate equalizing can be accomplished, for example, using fixed length data packets that can be defined to include for every segment of the speech signal a fixed number of output parameters. This and other methods of equalizing the output rate of a system are known in the art and will not be considered in f urther detail.

B. The Decoder

Figure 9:
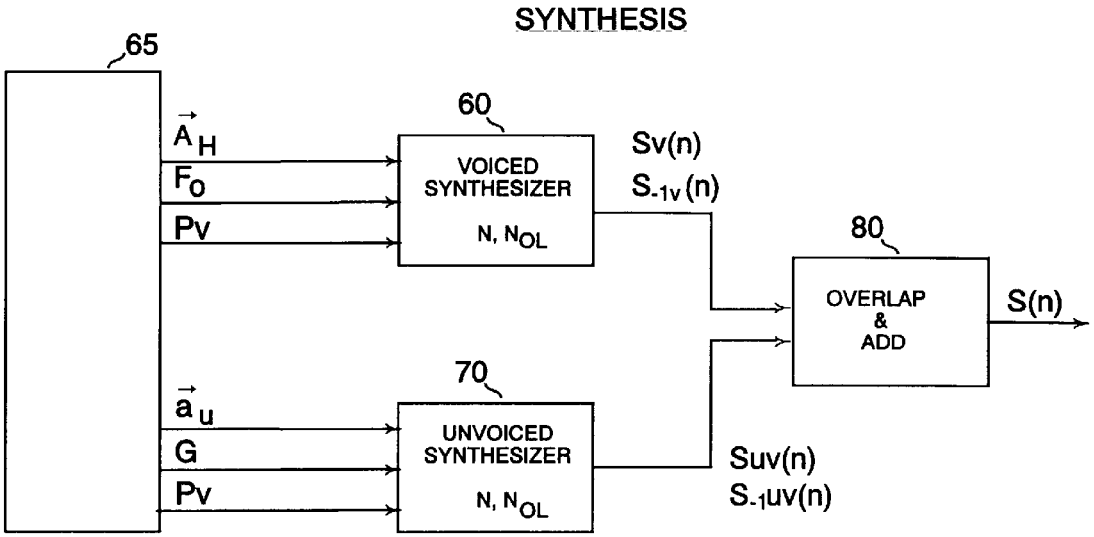
FIG. 9 illustrates in a schematic block-diagram form the decoder used in a preferred embodiment of the present invention and a method of adding signals in adjacent speech segments to synthesize the output speech signal.
Figure 9:
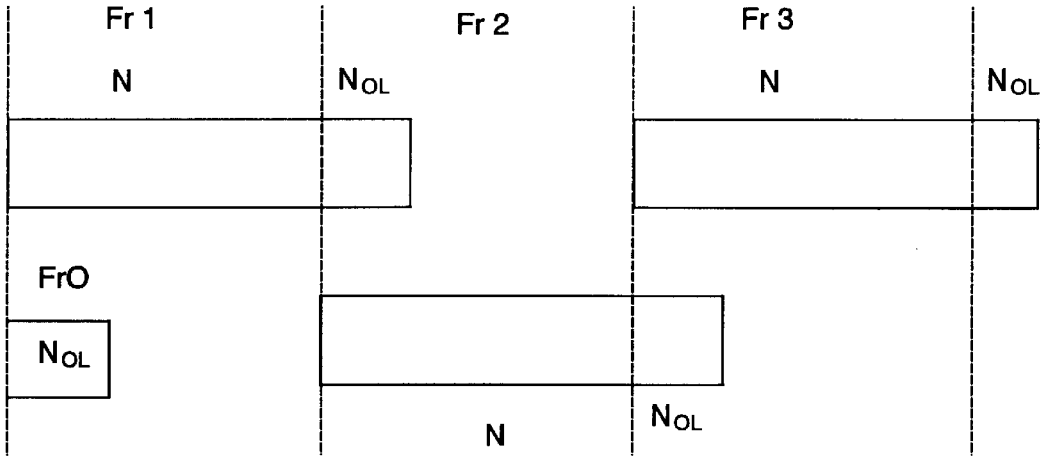

FIG. 9 is a schematic block diagram of speech decoder 8 in FIG. 2. Parameter decoding block 65 receives data packets 25 via communications channel 101. As discussed above, data packets 25 correspond to speech s egments with diffe rent voicing probability Pv. Additionally, each data packet 25 generally comprises a parameter related to the harmonic energy of the segment E; the fundamental frequency $F_0$; the estimated harmonic amplitudes vector $A_h$ for the voiced portion of the signal in each segment; and the encoded parameters of the LPC vector coefficients, or its equivalents, which represent the unvoiced portion of the signal in a speech segment. In the case when Pv=0 no voicing infor mation parameters are transmitted. Similarly, if Pv=1 no parameters related to an unvoiced portion of the signal are transmitted. Thus, data packets 25 in the system of the present invention generally have variable size.

In accordance with a preferred embodiment of the present invention, the voiced portion of the signal is decoded and reconstructed in voiced synthesizer 60; the unvoiced portion of the signal is reconstructed in unvoiced synthesizer 70. As shown in FIG. 9, each synthesizer block computes the signal in the current frame of length N, and also an overlapping portion of the signal from the immediately preceding frame. Once all signals required for the synthesis of the current frame are computed, in Overlap and Add block 80 of the decoder 8 the voiced and unvoiced portions of the signal are combined to generate a composite reconstructed output digital speech signal s(n). As indicated in the description of FIG. 1 above, the resulting digital signal is then passed through a digital-to-analog converter (DAC) to restore a time-delayed analog version of the original speech signal.

Figure 10:
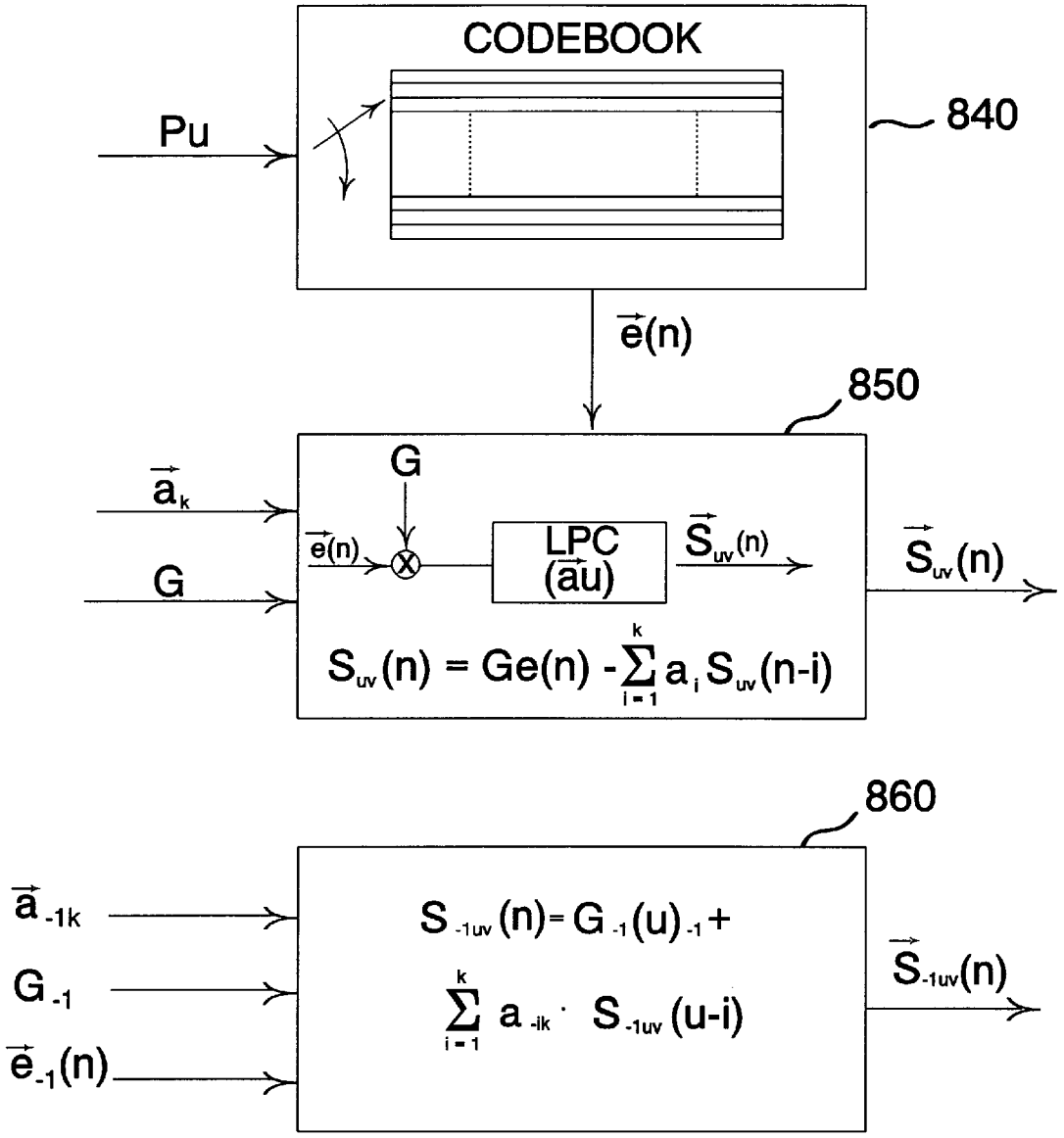
FIG. 10 illustrates a method of generating the unvoiced portion of the output speech signal in accordance with the present invention.

Turning first to the synthesis of the unvoiced portion of the speech signal, with reference to FIG. 10, in block 840 a noise excitation codebook entry is selected on the basis of the received voicing probability parameter Pv. In particular, stored as codebook entries in block 840 are several precomputed noise sequences which represent a time-domain signal that corresponds to different "unvoiced" portions of the spectrum of a speech signal. In a specific embodiment of the present invention, 16 different entries can be used to represent a whole range of unvoiced excitation signals which correspond to such 16 different voicing probabilities. For simplicity it is assumed that the spectrum of the original signal is divided into 16 equalwidth portions which correspond to those 16 voicing probabilities. Other divisions, such as a logarithmic frequency division in one or more parts of the signal spectrum, can also be used and are determined on the basis of computational complexity considerations or some subjective performance measure for the system.

In block 850 the received LPC coefficient vector $a_k$ of length P is loaded as coefficients of a prediction synthesis filter illustrated as component LPC in block 850. The unvoiced speech segment is synthesized by passing to the LPC synthesis filter the noise excitation sequence selected in block 840, which is gain adjusted on the basis of the transmitted prediction error power G. The mathematical expression used in the synthesis of the unvoiced portion of the speech segment is also shown in FIG. 10.

At the same time, with reference to the overlap and add illustration in FIG. 9, in block 860 is computed the portion of the signal in the immediately preceding frame which is extended in the current frame for continuity. Naturally, the old frame LPC coefficients vector $a_{-1k}$, gain $G_{-1}$ and noise excitation sequence $e_{-1}$ (n) are used to this end. Using the notations in FIG. 10 subscript −1 indicates a parameter which represents the signal in the immediately preceding speech frame.

The synthesis of voiced speech segments and the concatenation of segments into a continuous voice signal is accomplished in the system of the present invention using phase compensated harmonic synthesis block 60. The operation of harmonic synthesis block 60 has been generally described in U.S. Patent appllication Ser. No. 08/273,069, assigned to assignee of the present application. The content of this application is hereby expressly incorporated by re ference for all purposes. The following description briefly summarizes this operation in the context of the present invention, emphasizing the differences from the system in the '069 application which are due to the use of a voicing probability determination.

Figure 11:
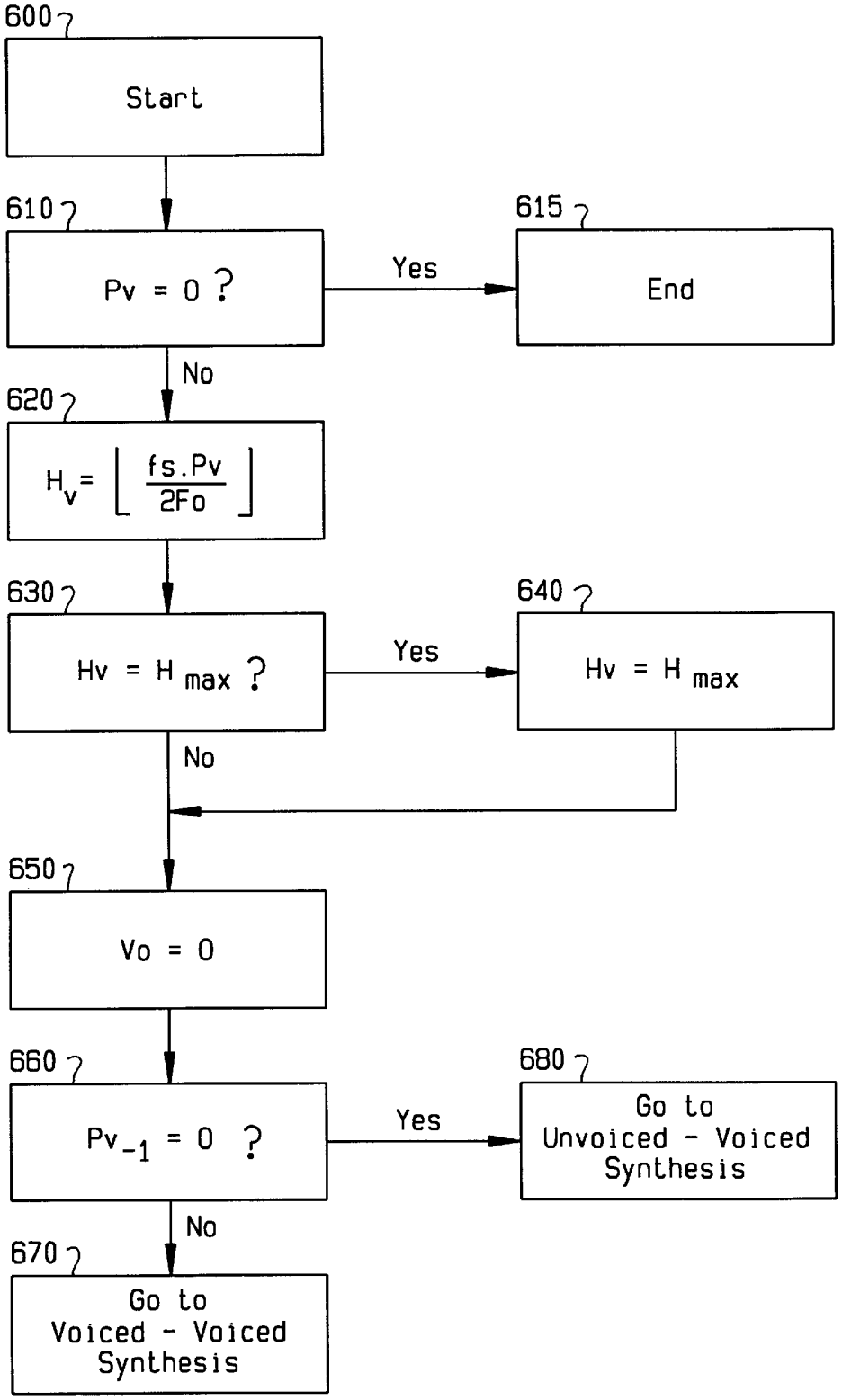
FIG. 11 illustrates a method of combining voiced and unvoiced portions of the output signal to obtain a composite reconstructed output speech signal.

The operation of synthesis block 60 is shown in greater detail in the flow diagram in FIG. 11. Specifically, in step 600 the synthesis algorithm receives input parameters from the parameter decoding block 65 which includes the voicing probability Pv, the fundamental frequency $F_0$ and the n ormalized harmonic amplitudes vector $A_H$.

If the voicing probability Pv is greater than zero, indicating a voiced or a partially voiced segment, in step 620 is calculated the number of harmonics Hv in the segment by dividing the sampling frequency $f_s$ of the system by twice the fundamental frequency $F_0$ for the segment and multiplying by the voicing probability Pv. The resulting number of harmonics Hv is truncated to the value of the closest smaller integer.

Decision step 630 compares next the value of the computed number of harmonics Hv to the maximum number of harmonics $H_{max}$ used in the operation of the system. If Hv is greater than $H_{max}$, in step 640 the value of Hv is set equal to $H_{max}$. In the following step 650 the elements of the voiced segment synthesis vector $V_0$ are initialized to zero.

In step 660 a flag $f^{-}_{v/uv}$ of previous segment is examined to determine whether the segment was unvoiced, i.e. whether Pv=0, in which case control is transferred in step 670 to the unvoiced-voiced synthesis algorithm. Otherwise, control is transferred to the voiced-voiced synthesis algorithm described next. Generally, the last sample of the previous speech segment is used as the initial condition in the synthesis of the current segment as to insure amplitude continuity in the signal transition ends.

In accordance with the present invention, voiced speech segments are concatenated subject to the requirement of both amplitude and phase continuity across the segment boundary. This requirement contributes to a significantly reduced distortion and a more natural sound of the synthesized speech. Clearly, if two segments have identical number of harmonics with equal amplitudes and frequencies, the above requirement would be relatively simple to satisfy. However, in practice all three parameters can vary and thus need to be matched separately.

In the system of the present invention, if the numbers of harmonics in two adjacent voiced segments are different, the algorithm proceeds to match the smallest number H of harmonics common to both segments. The remaining harmonics in any segment are considered to have zero amplitudes in the adjacent segment.

In accordance with a preferred embodiment of the present invention, amplitude discontinuity between harmonic components in adjacent speech frames is resolved by means of a linear amplitude interpolation such that at the beginning of the segment the amplitude of the signal S(n) is set equal to $A^-$ while at the end it is equal to the harmonic amplitude A. Mathematically this condition is expressed as $$A^-(m) + \frac{A(m) - A^-(m)}{M} \tag{25}$$

where M is the length of the overlap between adjacent speech segments.

In the more general case of H harmonic frequencies the current segment speech signal may be represented as follows:

$$S(m) = \sum_{h=0}^{H-1} \left( A^-(m) + \frac{A(m) - A^-(m)}{M} \cdot m \right) \sin((h+1)\Phi(m) + \xi(h)); \quad m = 0, \ldots, M-1. \tag{26}$$

where $\Phi(m)=2\pi\, m\, F_0/f_s$; and $\xi(h)$ is the initial phase of f the h-th harmonic. Assuming that the amplitudes of each two harmonic frequencies to be matched are equal, the condition for phase continuity may be expressed as an equality of the arguments of the sinusoids in Eq. (26) evaluated at the first sample of the current speech segment. This condition can be expressed mathematically as:

$$\begin{aligned} (h+1)\Phi(0) + \xi(h) &= (h+1)\,\Phi^-(M) + \xi^-(h) \\ \xi(h) &= \Phi^-(M) + \xi - (h); \quad \text{for } h = 0, \ldots, H-1 \end{aligned} \tag{27}$$

where $\Phi_-$ and $\xi_-$ denote the phase components for the previous segment and term $2\pi$ has been omitted for convenience. Since at m=0 the quantity $\Phi$ (m) is always equal to zero, Eq. (27) gives the condition to initialize the phases of all harmonics.

Figure 12:
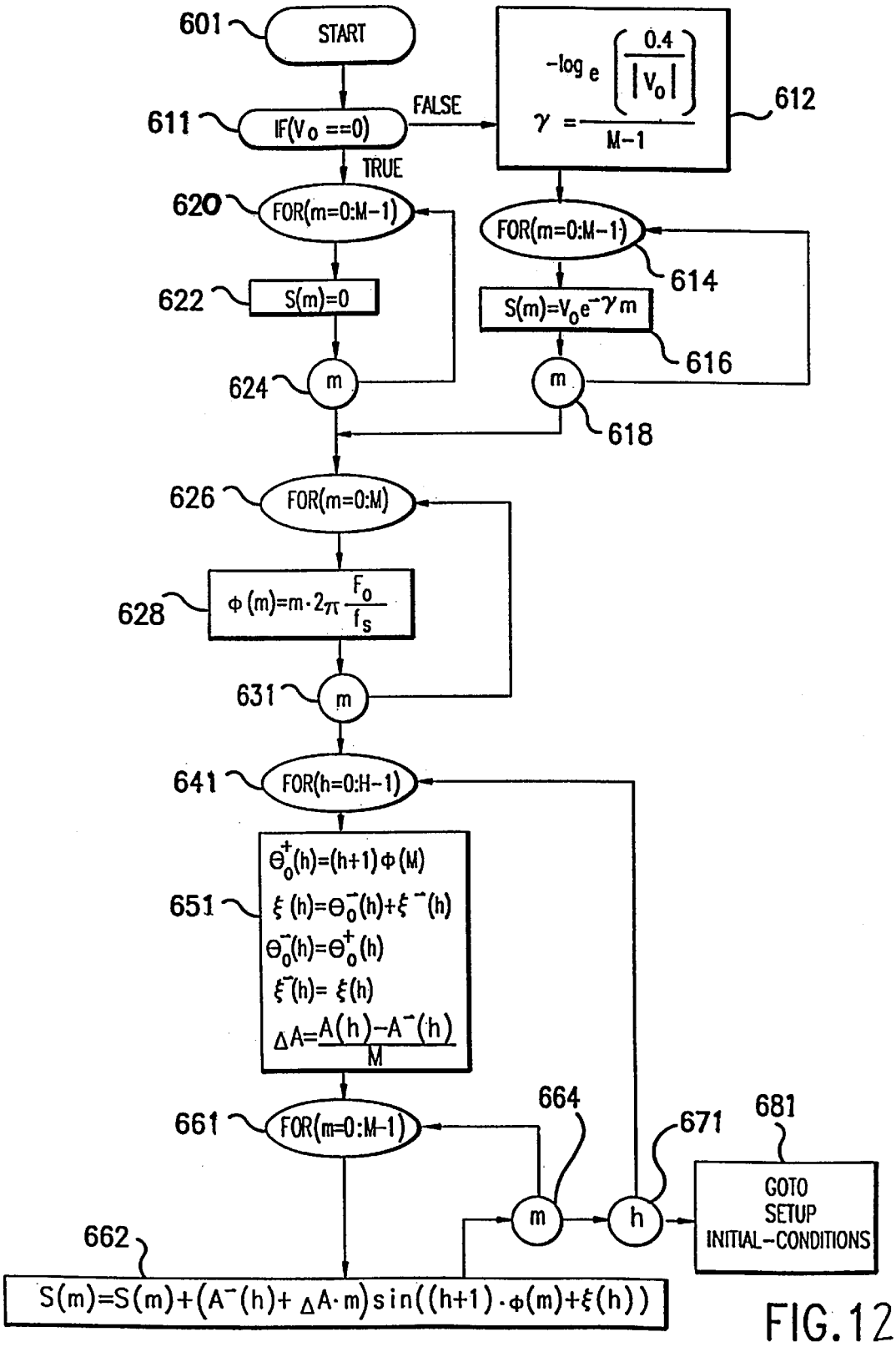
FIG. 12 is a flow diagram of the voiced-voiced synthesis block in the decoder of the present invention.

FIG. 12 is a flow diagram of the voiced-voiced synthesis block of the present invention which implements the above algorithm. Following initiation step 601 in step 611 the system checks whether there is a DC offset $V_0$ in the previous segment which has to be reduced to zero. If there is no such offset, in steps 621, 622 and 624 the system initializes the elements of the output speech vector to zero. If there is a DC offset, in step 612 the system determines the value of an exponential decay constant $\gamma$ using the expression:

$$\gamma = \frac{-\log\left(\frac{0.4}{|V_0|}\right)}{M-1} \tag{28}$$

where $V_0$ is the DC offset value.

In steps 614, 616 and 618 the constant $\gamma$ is used to initialize the output speech vector S(m) with an exponential decay function having a time constant equal to $\gamma$. The elements of speech vector S(m) are given by the expression:

$$S(m)=V_o e^{-\gamma \cdot m} \tag{29}$$

Following the initialization of the speech output vector, the system computes in steps 626, 628 and 631 the phase line ø (m) for time samples 0, . . . , M.

In steps 641 through 671 the system synthesizes a segment of voiced speech of length M samples which satisfies the conditions for amplitude and phase continuity to the previous voiced speech segment. Specifically, step 641 initializes a loop for the computation of all voiced harmonic frequencies $H_v$. In step 651 the system sets up the initial conditions for the amplitude and space continuity for each harmonic frequency as defined in Eqs. (25)–(29) above.

In steps 661, 662 and 664 the system loops through all M samples of the speech segment computing the synthesized voiced segment in step 662 and the initial conditions set up in step 651. When the synthesis signal is computed for all M points of the speech segment and all H harmonic frequencies, following step 671 control is transferred in step 681 to initial conditions block 801.

The unvoiced-to-voiced transition in accordance with the present invention is determined using the condition that the last sample of the previous segment $S^-(N)$ should be equal to the first sample of the current speech segment S(N+1), i.e. $S^-(N)=S(N+1)$. Since the current segment has a voiced portion, this portion can be modeled as a superposition of harmonic frequencies so that the condition above can be expressed as:

$$S(N)=A_1(\phi_1+\theta_1)+A_2(\phi_2+\theta_2)+\ldots+A_{H-1}sin(\phi_{H+1}l+\theta_{H-1})+\xi. \tag{30}$$

where $A_i$ is the i-th harmonics amplitude, $\phi_i$ and $\theta_i$ are the i-the harmonics phase and initial phase, respectively, and $\xi$ is an offset term modeled as an exponential decay function, as described above. Neglecting for a moment the $\xi$ term and assuming that at time n=N+1 all harmonic frequencies have equal phases, the following condition can be derived:

$$\begin{aligned} S(N) &= \alpha[A_0 + A_1 + \ldots + A_{H-1}) \\ \alpha &= \frac{S(N)}{\sum_{i=0}^{H-1} A_i} = \sin(\phi_i + \theta_i); \quad i = 0, \ldots, H-1. \end{aligned} \tag{31}$$

where it is assumed that $|\alpha|<1$ . This set of equations yields the initial phases of all harmonics at sample n=N+1, which are given by the following expression:

$$\theta_i=sin^{-1}(\alpha)-\phi_i; \text{ for } i=0, \ldots, H-1. \tag{32}$$

Figure 13:
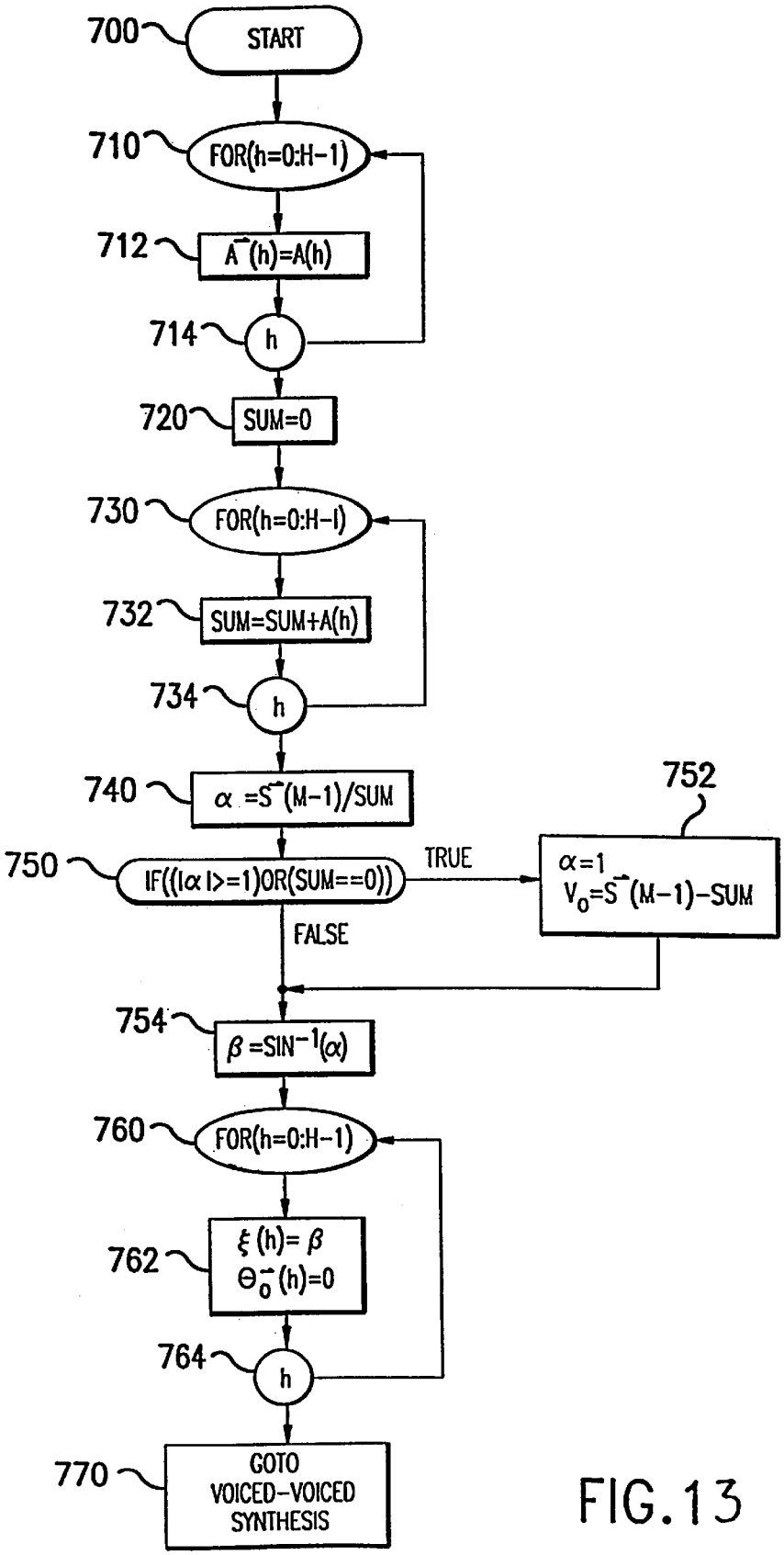
FIG. 13 is a flow diagram of the unvoiced-voiced synthesis block in the decoder of the present invention.

FIG. 13 is a flow diagram of the unvoiced-voiced synthesis block which implements the above algorithm. In step 700 the algorithm starts, following an indication that the previous speech segment was completely unvoiced (Pv=0). In steps 710 to 714 the vector comprising the harmonic amplitudes for the previous segment is updated to store the harmonic amplitudes of the current voiced segment.

In step 720 a variable Sum is set equal to zero and in the following steps 730, 732 and 734 the algorithm loops through the number of voiced harmonic frequencies $H_v$, adding the estimated amplitudes until the variable Sum contains the sum of all amplitudes of the harmonic frequencies. In the following step 740, the system computes the value of the parameter a after checking whether the sum of all harmonics is not equal to zero. In steps 750 and 752 the value of a is adjusted, if $|\alpha|>1$. Next, in step 754 the algorithm computes the constant phase offset $\beta=\sin^{-1}(\alpha)$. Finally, in steps 760, 762 and 764 the algorithm loops through all harmonics to determine the initial phase offset $\theta_i$ for each harmonic frequency.

Figure 14:
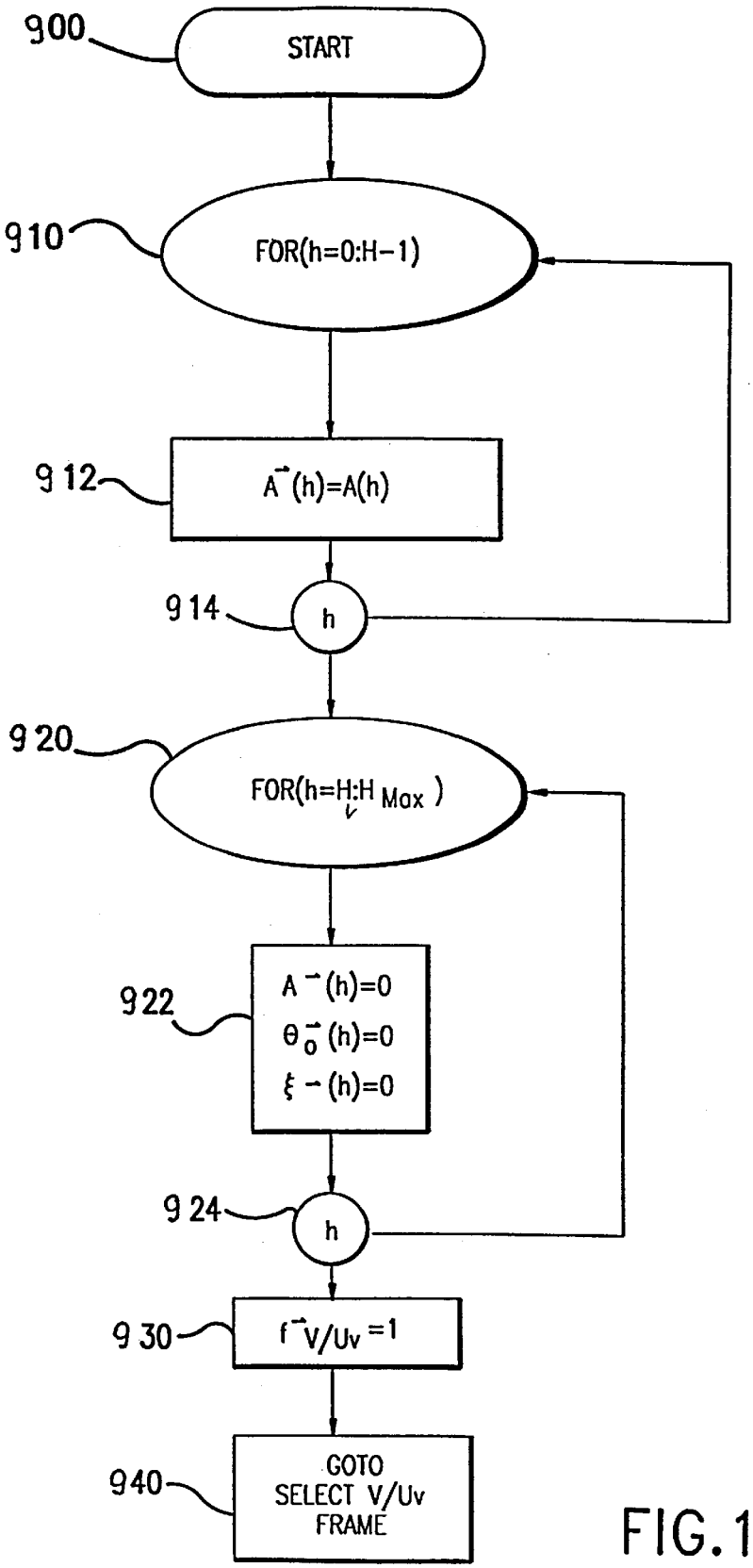
FIG. 14 is a flow diagram illustrating the method of storing the parameters of the synthesized segment in a memory for use in the synthesis of the next frame.

Following the synthesis of the speech segment, the system of the present invention stores in a memory the parameters of the synthesized segment to enable the computation of the amplitude and phase continuity parameters used in the following speech frame. The process is illustrated in a flow diagram form in FIG. 14 where in step 900 the amplitudes and phases of the harmonic frequencies of the voiced frame are loaded. In steps 910 to 914 the system updates the values of the H harmonic amplitudes actually used in the last voiced frame. In steps 920 to 924 the system sets the values for the parameters of the unused $H_{max}$–Hv harmonics to zero. In step 930 the voiced/unvoiced flag $f_{v/uv}$ is set dependent on the value of the voicing probability parameter Pv. The algorithm exits in step 940.

Figure 15:
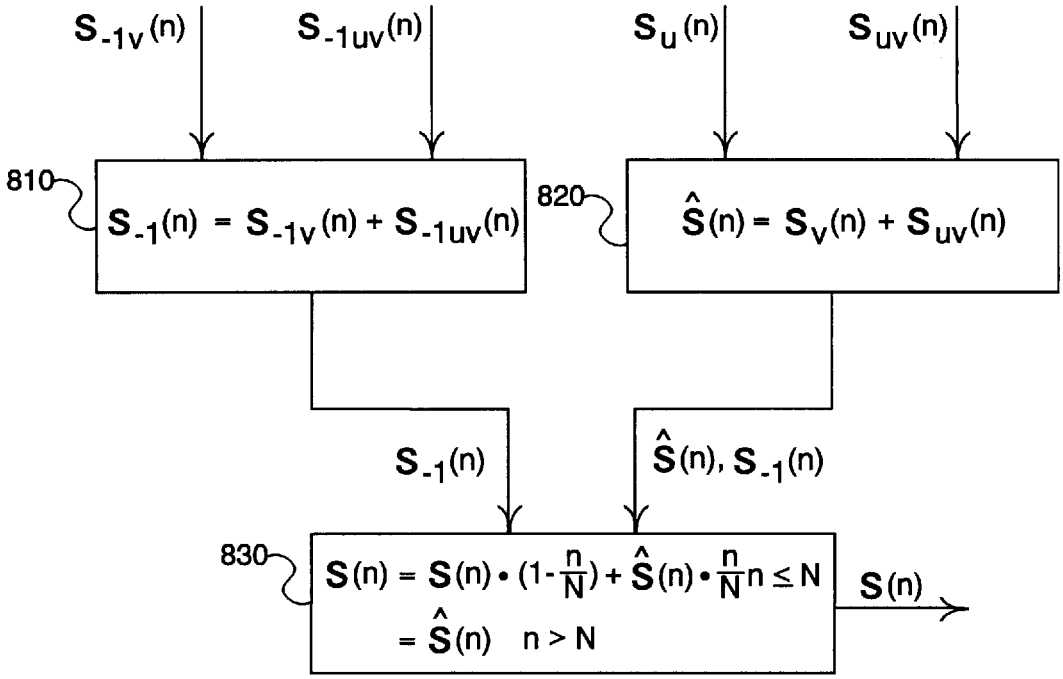
FIG. 15 illustrates the operation of the speech synthesis block in which voiced and unvoiced portions of the current speech frame are combined in an overlap segment with the tail end of the signal in the preceding speech frame.

FIG. 15 shows synthesis block 80 in accordance with the system of the present invention in which the voiced and unvoiced portions of the current speech frame computed in block step 820 are combined in block step 830 within the overlap section of the tail end of the signal in the preceding speech frame which is computed in block step 810. Within this overlap zone $N_{OL}$, as shown in FIG. 9, the tail end of the signal in the previous frame is linearly decreased, while the signal estimate $\overline{S}_{hat}(n)$ of the current frame is allowed to increase from a zero value at the beginning of the frame to its full value $N_{OL}$ samples later. It has been experimentally shown that while the exact matching of harmonic components of the speech signal at the end of each segment, as described in the '069 application, gives acceptable results, the system of the present invention using an overlap set of samples in which the earlier segment signal gradually decreases to zero and the current frame signal increases from zero to its full amplitude is rated perceptually by listeners much better.

Decoder block 8 has been described with reference to a specific preferred embodiment of the system of the present invention. As discussed in more detail in Section A above, however, the system of this invention is modular in the sense that different blocks can be used for encoding of the voiced and unvoiced portions of the signal dependent on the application and other user-specified criteria. Accordingly, for each specific embodiment of the encoder of the system, corresponding changes need to be made in the decoder 8 of the system for synthesizing output speech having desired quantitative and perceptual characteristics. Such modifications should be apparent to a person skilled in the art and will not be discussed in further detail.

C. Applications

The method and system of the present invention described above in a preferred embodiment using 11 kHz sampling rate can in fact provide the capability of accurately encoding and synthesizing speech signals for a range of user-specific bit rates. Because of the modular structure of the system in which different portions of the signal spectrum can be processed separately using different suitably optimized algorithms, the encoder and decoder blocks can be modified to accommodate specific user needs, such as different system bit rates, by using different signal processing modules. Furthermore, in addition to straight speech coding, the analysis and synthesis blocks of the system of the present invention can also be used in speech enhancement, recognition and in the generation of voice effects. Furthermore, the analysis and synthesis method of the present invention, which are based on voicing probability determination, provide natural sounding speech which can be used in artificial synthesis of a user's voice.

The method and system of the present invention may also be used to generate a variety of sound effects. Two different types of voice effects are considered next in more detail for illustrative purposes. The first voice effect is what is known in the art as time stretching. This type of sound effect may be created if the decoder block uses synthesis frame sizes different from that of the encoder. In such case, the synthesized time segments are expanded or contracted in time compared to the originals, changing the rate of playback. In the system of the present invention this effect can easily be accomplished simply by using, in the decoder block 8, of different values for the frame length N and the overlap portion $N_{OL}$. Experimentally it has been demonstrated that the output signal of the present system can be effectively changed with virtually no perceptual degradation by a factor of about five in each direction (expansion or contraction). Thus, the system of the present invention is capable of providing a naturally sounding speech signal over a range of applications including dictation, voice scanning, and others. (Notably, the perceptual quality of the signal is preserved because the fundamental frequency $F_0$ and the general position of the speech formants in the spectrum of the signal is preserved). The use of different frame sizes at the input and the output of the system 12 may also be employed to provide matching between encoding and decoding processor blocks operating at different sampling rates.

Figure 16:
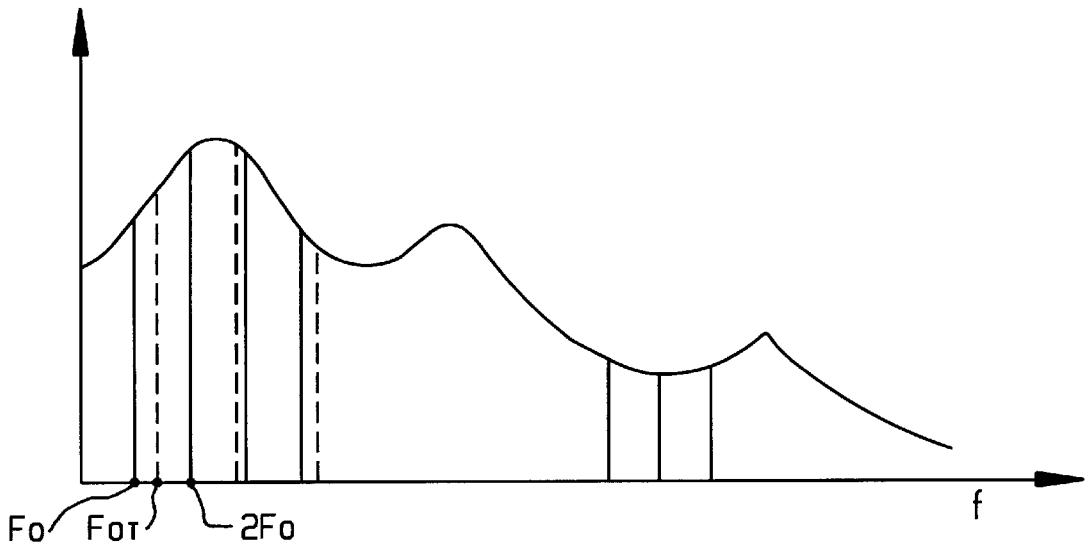
FIG. 16 illustrates a method used in accordance with the present invention to change the pitch of the output signal to a desired target range.

In addition, changing the pitch frequency $F_0$ and the harmonic amplitudes in the decoder block will have the perceptual effect of altering the voice personality in the synthesized speech with no other modifications of the system being required. Thus, in some applications while retaining comparable levels of intelligibility of the synthesized speech the decoder block of the present invention may be used to generate different voice personalities. Specifically, in a preferred embodiment, the system of the present invention is capable of generating a signal in which the pitch corresponds to a predetermined target value $F_{0T}$. FIG. 16 illustrates a simple mechanism by which this voice effect can be accomplished. Suppose for example that the spectrum envelope of an actual speech signal and the fundamental frequency $F_0$, and its harmonics are as shown in FIG. 16. Using the system of the present invention the model spectrum $S(\omega)$ can be generated from the reconstructed output signal. (Notably, the pitch period and its harmonic frequencies are directly available as encoding parameters). Next, the continuous spectrum $S(\omega)$ can be re-sampled to generate the spectrum amplitudes at the target fundamental frequency $F_{0T}$ and its harmonics. In an approximation, such re-sampling, in accordance with a preferred embodiment of the present invention, can easily be computed using linear interpolation between the amplitudes of adjacent harmonics. Next, at the synthesis block, instead of using the originally received pitch $F_0$ and the amplitudes of its harmonics, one can use the target values obtained by interpolation, as indicated above. This pitch shifting operation has been shown in real time experiments to provide perceptually very good results. Furthermore, the system of the present invention can also be used to dynamically change the pitch of the reconstructed signal in accordance with a sequence of target pitch values, each target value corresponding to a specified number of speech frames. The sequence of target values for the pitch can be pre-programmed for generation of a specific voice effect, or can be interactively changed in real time by the user.

It should further be noted that while the method and system of the present invention have been described in the context of a specific speech processing environment, they are also applicable in the more general context of audio processing. Thus, the input signal of the system may include music, industrial sounds and others. In such case, dependent on the application, it may be necessary to use sampling frequency higher or lower than the one used for speech, and also adjust the parameters of the filters in order to adequately represent all relevant aspects of the input signal. When applied to music, it is possible to bypass the unvoiced segment processing portions of the encoder and the decoder of the present system and merely transmit or store the harmonic amplitudes of the input signal for subsequent synthesis. Furthermore, harmonic amplitudes corresponding to different tones of a musical instrument may also be stored at the decoder of the system and used independently for music synthesis. Compared to conventional methods, music synthesis in accordance with the method of the present invention has the benefit of using significantly less memory space as well as more accurately representing the perceptual spectral content of the audio signal.

While the invention has been described with reference to a preferred embodiment, it will be appreciated by those of ordinary skill in the art that modifications can be made to the structure and form of the invention without departing from its spirit and scope which is defined in the following claims.

What is claimed is:

1. A method for processing an audio signal comprising the steps of:

dividing the signal into segments, each segment representing one of a succession of time intervals;

detecting for each segment the presence of a fundamental frequency $F_0$;

determining for each segment a ratio between voiced and unvoiced components of the signal in such segment on the basis of the fundamental frequency $F_0$, said ratio being defined as a voicing probability Pv;

separating the signal in each segment into a voiced portion and an unvoiced portion on the basis of the voicing probability Pv; and encoding the voiced portion and the unvoiced portion of the signal in each segment in separate data paths.

2. The method of claim 1 wherein the audio signal is a speech signal and the step of detecting the presence of a fundamental frequency $F_0$ comprises the step of computing the spectrum of the signal.

5. The method of claim 4 further comprising the step of encoding the prediction error power associated with the computed LPC coefficients.

6. The method of claim 4 wherein the step of encoding the LPC coefficients comprises the steps of computing line spectral frequencies (LSF) coefficients corresponding to the LPC coefficients and encoding of the computed LSF coefficients for subsequent storage and transmission.

7. The method of claim 6 wherein the step of computing the spectrum of the signal comprises the step of performing a Fast Fourier transform (FFT) of the signal in the segment; and the step of encoding the voiced portion of the signal in each segment comprises the step of computing a set of harmonic amplitudes which provide a representation of the voiced portion of the signal.

8. The method of claim 7 further comprising the step of forming a data packet corresponding to each segment for subsequent transmission or storage, the packet comprising: the fundamental frequency $F_0$, and the voicing probability Pv for the signal in the segment.

9. The method of claim 8 wherein the data packet further comprises: a normalized harmonic amplitudes vector $A_{Hv}$ within the voiced portion of the spectrum, the sum of all harmonic amplitudes, a vector the elements of which are the parameters related to LPC coefficients representing the unvoiced portion of the spectrum, and the linear prediction error power associated with the computed LPC coefficients.

10. The method of claim 2 wherein the step of computing the spectrum of the signal comprises the step of performing a Fast Fourier transform (FFT) of the signal in the segment; and the step of encoding the voiced portion of the signal in each segment comprises the step of computing a set of harmonic amplitudes which provide a representation of the voiced portion of the signal.

11. The method of claim 10 wherein the harmonic amplitudes are obtained using the expression:

$$A_H(h, F_o) = \left[ \frac{4}{N \sum_{n=0}^{Nw-1} W^2(n)} \cdot \sum_{k=\left[(h+1)\frac{F_o}{f_s} N\right] - Bw(F_o)}^{\left[(h+1)\frac{F_o}{f_s} N\right] + Bw(F_o)} \left[ \sum_{n=0}^{N-1} s_{Nw}(n) w_{Nw}(n) \cdot e^{-j2\pi \frac{k}{N} \cdot n} \right]^2 \right]^{\frac{1}{2}};$$

$$h = 0, 1, 2, \ldots, H-1; \quad H \leqq \left[ \frac{f_s Pv}{2F_o} \right]$$

3. The method of claim 2 wherein the voiced portion of the signal occupies the low end of the spectrum and the unvoiced portion of the signal occupies the high end of the spectrum for each segment.

4. The method of claim 2 wherein the step of encoding the unvoiced portion of the signal in each segment comprises the steps of:

setting to a zero value the components in the signal spectrum which correspond to the voiced portion of the spectrum;

generating a time domain signal corresponding to the remaining components of the signal spectrum which correspond to the unvoiced portion of the spectrum;

computing a set of linear predictive coding (LPC) coefficients for the generated unvoiced time domain signal; and encoding the computed LPC coefficients for subsequent storage and transmission.

where $A_H(h,F_0)$ is the estimated amplitude of the h-th harmonic frequency, $F_0$ is the fundamental frequency of the segment; $B_W(F_0)$ is the half bandwidth of the main lobe of the Fourier transform of the window function; $W_{Nw}(n)$ is a windowing function of length Nw; and $S_{Nw}(n)$ is a speech signal of length Nw.

12. The method of claim 11 wherein prior to the step of performing a FFT the speech signal is windowed by a window function providing reduced spectral leakage and the used function is a normalized Kaiser window.

13. The method of claim 11 wherein following the computation of the harmonic amplitudes $A_{Fo}(h)$ in the voiced portion of the spectrum each amplitude is normalized by the sum of all amplitudes and is encoded to obtain a harmonic amplitude vector $A_{Hv}$ having Hv elements representative of the signal segment.

14. The method of claim 2 wherein the step of determining a ratio between voiced and unvoiced components further comprises the steps of:

computing an estimate of the fundamental frequency $F_0$;

generating a fully voiced synthetic spectrum of a signal corresponding to the computed estimate of the fundamental frequency $F_0$;

evaluating an error measure for each frequency bin corresponding to harmonics of the computed estimate of the fundamental frequency in the spectrum of the signal; and determining the voicing probability Pv of the segment as the ratio of harmonics for which the evaluated error measure is below certain threshold and the total number of harmonics in the spectrum of the signal.

15. A method for synthesizing audio signals from data packets, each data packet representing a time segment of a signal, said at least one data packet comprising: a fundamental frequency parameter, voicing probability Pv defined as a ratio between voiced and unvoiced components of the signal in the segment, and a sequence of encoded parameters representative of the voiced portion and the unvoiced portion of the signal, the method comprising the steps of:

decoding at least one data packet to extract said fundamental frequency, the number of harmonics H corresponding to said fundamental frequency said voicing probability Pv and said sequence of encoded parameters representative of the voiced and unvoiced portions of the signal; and synthesizing an audio signal in response to the detected fundamental frequency, wherein the low frequency band of the spectrum is synthesized using only parameters representative of the voiced portion of the signal; the high frequency band of the spectrum is synthesized using only parameters representative of the unvoiced portion of the signal and the boundary between the low frequency band and the high frequency band of the spectrum is determined on the basis of the decoded voicing probability Pv and the number of harmonics H.

16. The method of claim 15 wherein the audio signals being synthesized are speech signals and wherein following the step of detecting the method further comprises the steps of:

providing amplitude and phase continuity on the boundary between adjacent synthesized speech segments.

17. The method of claim 16 wherein the parameters representative of the unvoiced portion of the signal are related to the LPC coefficients for the unvoiced portion of the signal and the step of synthesizing unvoiced speech further comprises the steps of: selecting on the basis of the voicing probability Pv of a filtered excitation signal; passing the selected excitation signal through a time varying autoregressive digital filter the coefficients of which are the LPC coefficients for the unvoiced portion of the signal and the gain of the filter is adjusted on the basis of the prediction error power associated with the LPC coefficients.

18. The method of claim 17 wherein the parameters representative of the voiced portion of the signal comprise a set of amplitudes for harmonic frequencies within the voiced portion of the spectrum, and the step of synthesizing a voiced speech further comprises the steps of:

determining the initial phase offsets for each harmonic frequency; and synthesizing voiced speech using the encoded sequence of amplitudes of harmonic frequencies and the determined phase offsets.

19. The method of claim 18 wherein the step of providing amplitude and phase continuity on the boundary between adjacent synthesized speech segments comprises the steps of:

determining the difference between the amplitude A(h) of h-th harmonic in the current segment and the corresponding amplitude $A^-(h)$ of the previous segment, the difference being denoted as $\Delta A(h)$; and providing a linear interpolation of the current segment amplitude between the end points of the segment using the formula:

$$A(h,m)=A^-(h,0)+m\cdot\Delta A(h)/M, \text{ for } m=0, \ldots, M-1.$$

20. The method of claim 19 wherein the voiced speech is synthesized using the equation:

$$S(m) = \sum_{h=0}^{H-1}\left(A^-(m)+\frac{\Delta A(m)}{M}\cdot m\right)\sin((h+1)\phi(m)+\xi(h)); \quad (33)$$

$$m = 0, \ldots, M-1$$

where $A^-(h)$ is the amplitude of the signal at the end of the previous segment; $\phi(m)=2\pi\, m\, F_0/f_s$, where $F_0$ is the fundamental frequency and $f_s$ is the sampling frequency; and $\xi((h)$ is the initial phase of the h-th harmonic.

21. The method of claim 20 wherein phase continuity for each harmonic frequency in adjacent voiced segments is insured using the boundary condition:

$$\xi(h)=(h+1)\phi^-(M)+\xi^-(h),$$

where $\phi^-(M)$ and $\xi^-(h)$ are the corresponding quantities of the previous segment.

22. The method of claim 21 further comprising the step of generating voice effects by changing the fundamental frequency $F_0$. and the amplitudes and frequencies of the harmonics.

23. The method of claim 22 further comprising the step of generating voice effects by varying the length of the synthesized signal segments and adjusting the amplitudes and frequencies of the harmonics to a target range of values on the basis of a linear interpolation of the parameters encoded in the data packet.

24. A system for processing an audio signal comprising:

means for dividing the signal into segments, each segment representing one of a succession of time intervals;

means for detecting for each segment the presence of a fundamental frequency $F_0$;

means for determining for each segment a ratio between voiced and unvoiced components of the signal in such segment on the basis of the fundamental frequency $F_0$, said ratio being defined as a voicing probability Pv;

means for separating the signal in each segment into a voiced portion and an unvoiced portion on the basis of the voicing probability Pv; wherein the voiced portion of the signal occupies the low end of the spectrum and the unvoiced portion of the signal occupies the high end of the spectrum for each segment; and means for encoding the voiced portion and the unvoiced portion of the signal in each segment in separate data paths.

25. The system of claim 24 wherein the audio signal is a speech signal and the means for detecting the presence of a fundamental frequency $F_0$ comprises means for computing the spectrum of the signal.

26. The system of claim 25 wherein said means for encoding the unvoiced portion of the signal comprises means for computing LPC coefficients for a speech segment and means for transforming LPC coefficients into line spectral frequencies (LSF) coefficients corresponding to the LPC coefficients.

27. The system of claim 25 wherein said means for computing the spectrum of the signal comprises means for performing a Fast Fourier transform (FFT) of the signal in the segment.

28. The system of claim 27 further comprises windowing means for windowing a segment by a function providing reduced spectral leakage.

29. The system of claim 24 wherein said means for determining a ratio between voiced and unvoiced components further comprises:

means for computing an estimate of the fundamental frequency $F_0$;

means for generating a fully voiced synthetic spectrum of a signal corresponding to the computed estimate of the fundamental frequency $F_0$;

means for evaluating an error measure for each frequency bin corresponding to harmonics of the computed estimate of the fundamental frequency in the spectrum of the signal; and means for determining the voicing probability Pv of the segment as the ratio of harmonics for which the evaluated error measure is below certain threshold and the total number of harmonics in the spectrum of the signal.

30. A system for synthesizing audio signals from data packets, each data packet representing a time segment of a signal, said at least one data packet comprising: a fundamental frequency parameter, voicing probability Pv defined as a ratio between voiced and unvoiced components of the signal in the segment, and a sequence of encoded parameters representative of the voiced portion and the unvoiced portion of the signal, the system comprising:

means for decoding at least one data packet to extract said fundamental frequency, the number of harmonics H corresponding to said fundamental frequency, said voicing probability Pv and said sequence of encoded parameters representative of the voiced and unvoiced portions of the signal; and means for synthesizing an audio signal in response to the detected fundamental frequency, wherein the low frequency band of the spectrum is synthesized using only parameters representative of the voiced portion of the signal; the high frequency band of the spectrum is synthesized using only parameters representative of the unvoiced portion of the signal and the boundary between the low frequency band and the high frequency band of the spectrum is determined on the basis of the decoded voicing probability Pv and the number of harmonics H.

31. The system of claim 30 wherein the audio signals being synthesized are speech signals and wherein the system further comprises means for providing amplitude and phase continuity on the boundary between adjacent synthesized speech segments.

32. The system of claim 31 wherein the parameters representative of the unvoiced portion of the signal are related to the LPC coefficients for the unvoiced portion of the signal and the means for synthesizing unvoiced speech further comprises: means for generating filtered white noise signal; means for selecting on the basis of the voicing probability Pv of a filtered white noise excitation signal; and a time varying autoregressive digital filter the coefficients of which are determined by the parameters representing the unvoiced portion of the signal.

33. The system of claim 32 further comprising means for generating voice effects by varying the length of the synthesized signal segments and adjusting the parameters representing voiced and unvoiced spectrum to a target range of values on the basis of a linear interpolation of the parameters encoded in the data packet.

34. A system for processing speech signals divided in a succession of frames, each frame corresponding to a time interval, the system comprising:

a pitch detector;

a processor for determining the ratio between voiced and unvoiced components in each signal frame on the basis of a detected pitch and for computing the number of harmonics H corresponding to the detected pitch; said ratio being defined as the voicing probability Pv;

a filter for dividing the spectrum of the signal frame into a low frequency band and a high frequency band, the boundary between said bands being determined on the basis of the voicing probability Pv and the number of harmonics H; wherein the low frequency band corresponds to the voiced portion of the signal and the high frequency band corresponds to the unvoiced portion of the signal;

first encoder for encoding the voiced portion of the signal in the low frequency band; and second encoder for encoding the unvoiced portion of the signal in the high frequency band.

* * * * *